US005566914A

United States Patent [19]

Thomas

[11] Patent Number: 5,566,914

[45] Date of Patent: Oct. 22, 1996

[54] SIGN SUPPORT STAKE

[76] Inventor: John E. Thomas, 50 Mary Street West, Lindsay, Ontario, Canada, K9V 4S7

[21] Appl. No.: 345,400

[22] Filed: Nov. 21, 1994

Related U.S. Application Data

[63] Continuation-in-part of Ser. No. 223,231, Apr. 5, 1994, Pat. No. 5,489,076, which is a continuation-in-part of Ser. No. 93,660, Jul. 20, 1993, Pat. No. 5,340,065.

[51] Int. Cl.[6] ..... A45F 3/44

[52] U.S. Cl. ..... 248/156; 248/508; 254/30; 404/71; 404/79

[58] Field of Search ..... 248/508, 351, 248/542, 545, 530, 156; 404/79, 71; 254/30, 31, 132, 45

[56] References Cited

U.S. PATENT DOCUMENTS

| | | | |
|---|---|---|---|
| 4,249,715 | 2/1981 | Repp | 248/545 |
| 4,376,598 | 3/1983 | Brouns et al. | 404/79 X |
| 4,817,917 | 4/1989 | Stultz et al. | 254/30 |
| 5,052,659 | 10/1991 | Bates | 254/30 X |
| 5,305,976 | 4/1994 | Blanchard | 248/508 X |
| 5,340,063 | 2/1994 | Thomas | 248/150 |
| 5,375,801 | 12/1994 | Porter | 248/156 |

FOREIGN PATENT DOCUMENTS

| | | | |
|---|---|---|---|
| 289091 | 6/1953 | Switzerland | 248/542 |

*Primary Examiner*—Ramon O. Ramirez

[57] ABSTRACT

A sign support stake may be combined with a jack for extraction of the stake. The sign support stake may also provide a heater to melt frozen earth. The sign support can be provided with releasable attachment means to the support to avoid removal by vandals and may be provided with level indicating means to assist achieving vertical orientation for a driven stake.

21 Claims, 17 Drawing Sheets

Figure 1:
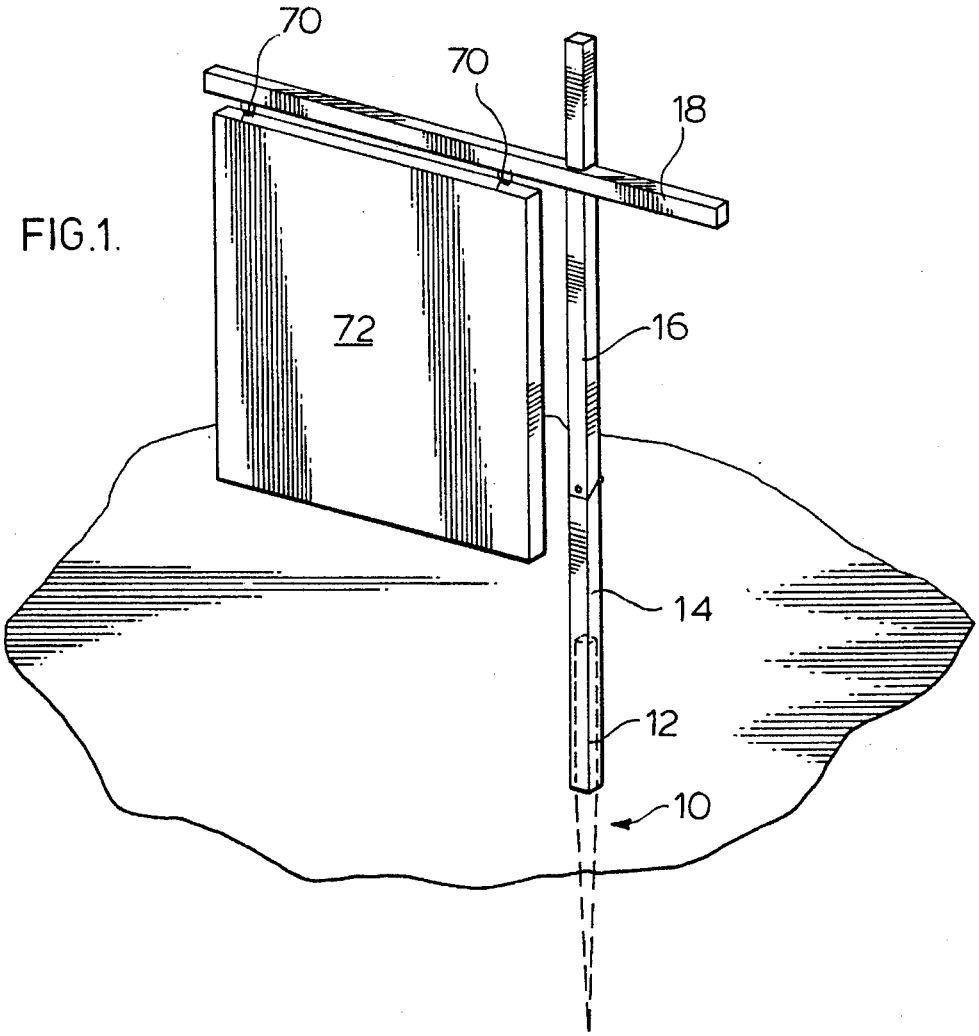

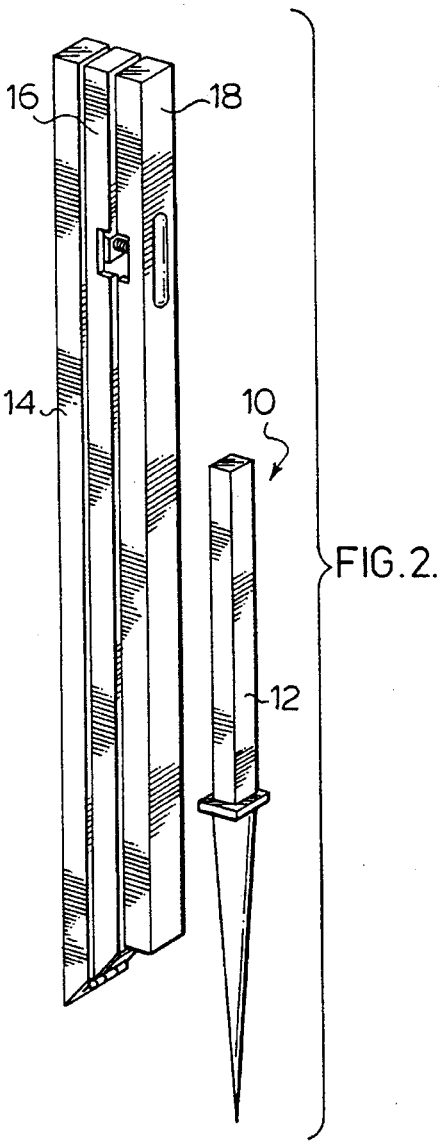
FIG. 6.
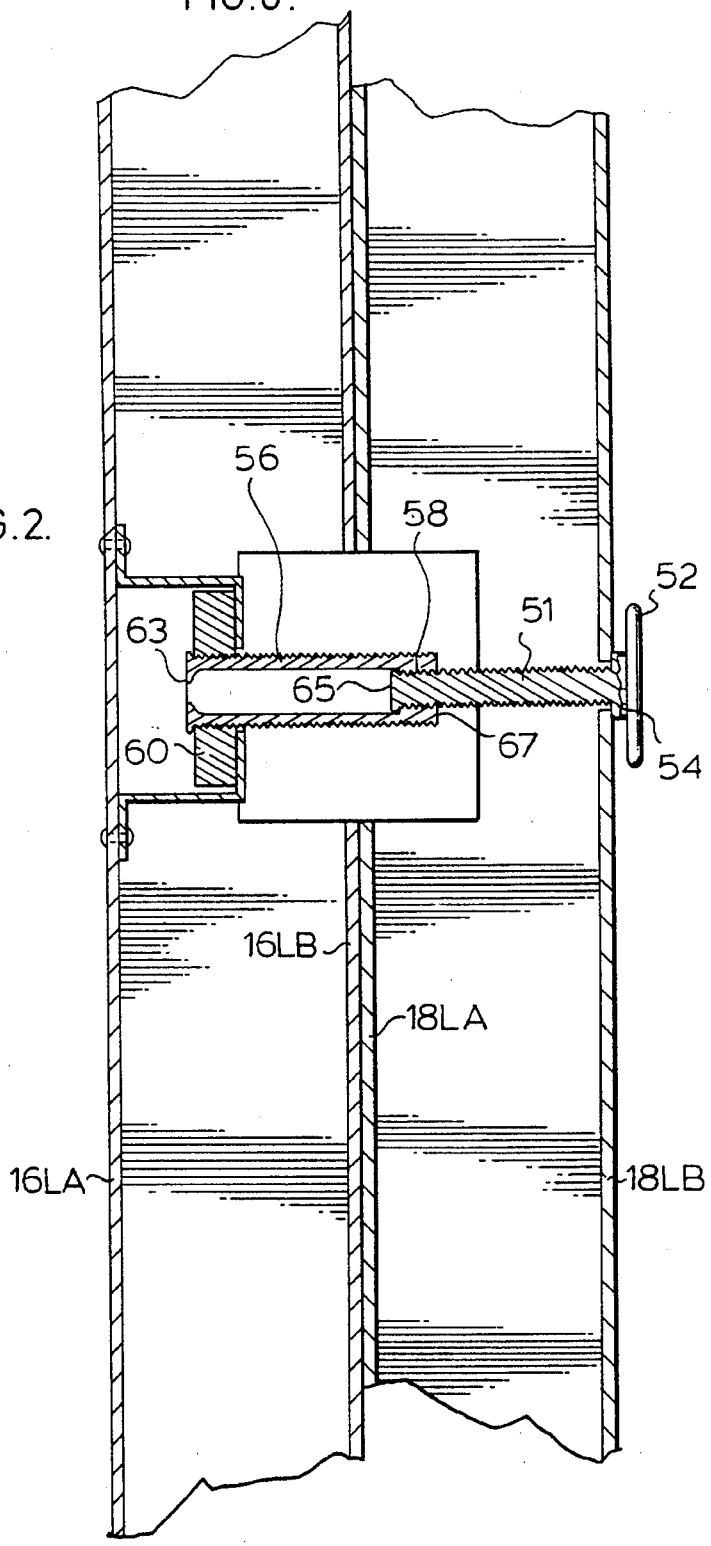

FIG. 5A.
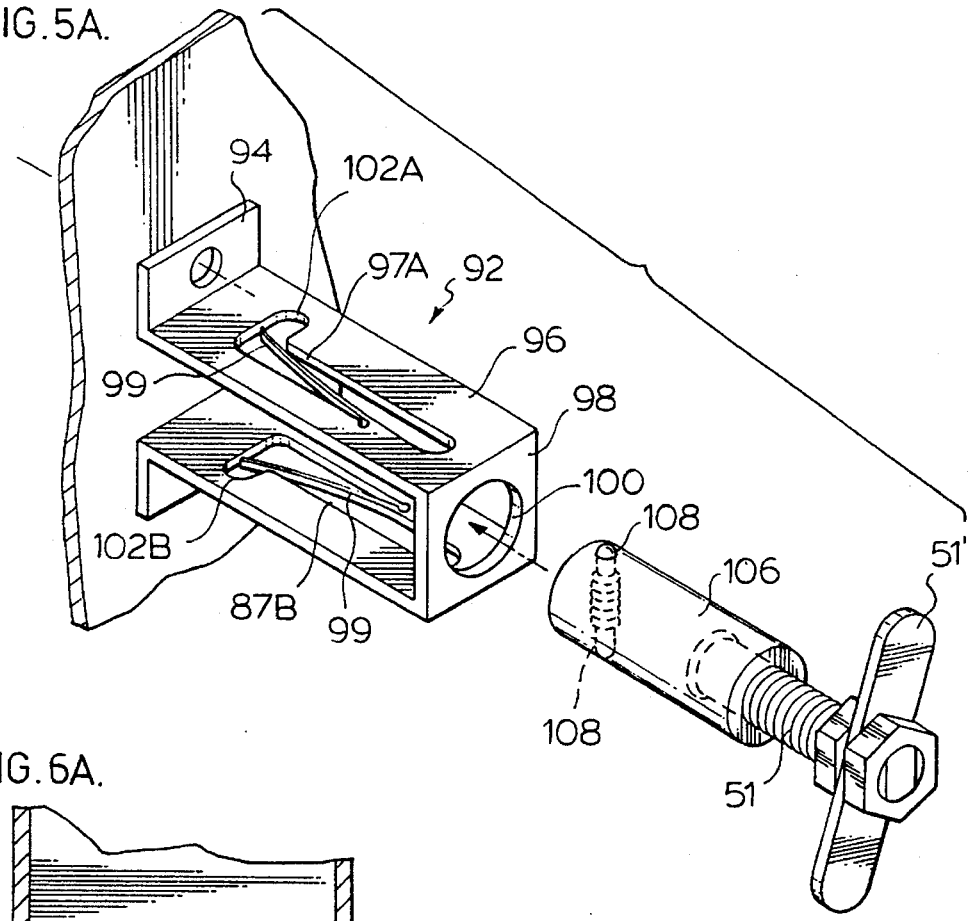
FIG. 6A.
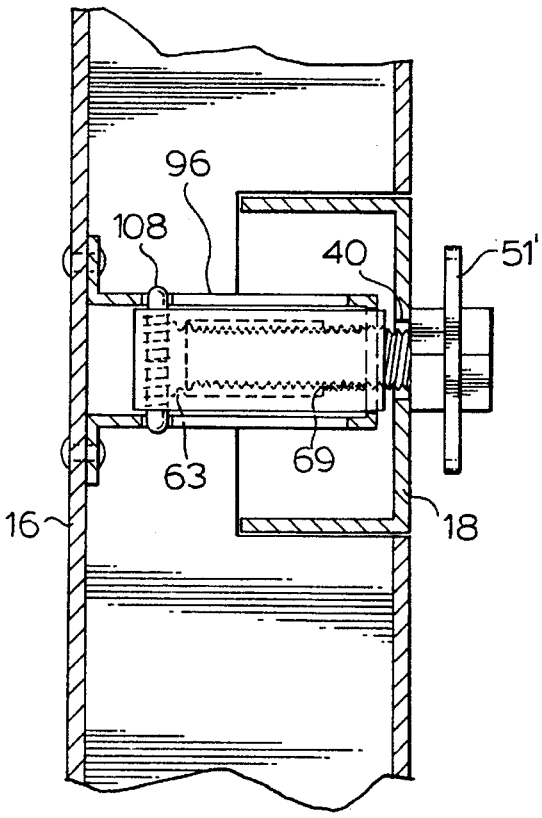
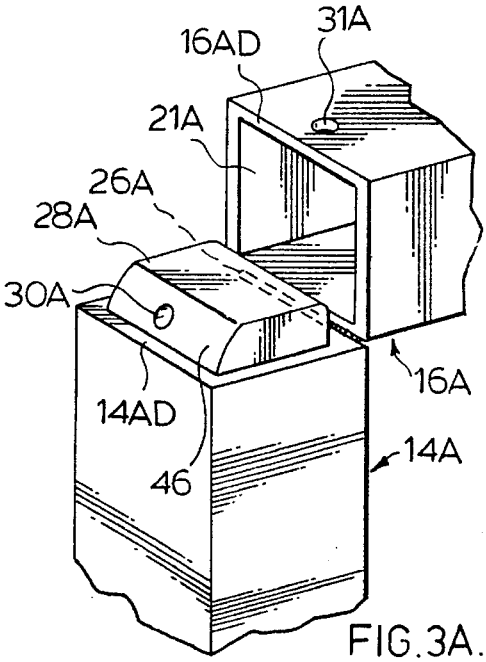
FIG. 3A.

316
321
320
318
326
328
323
314

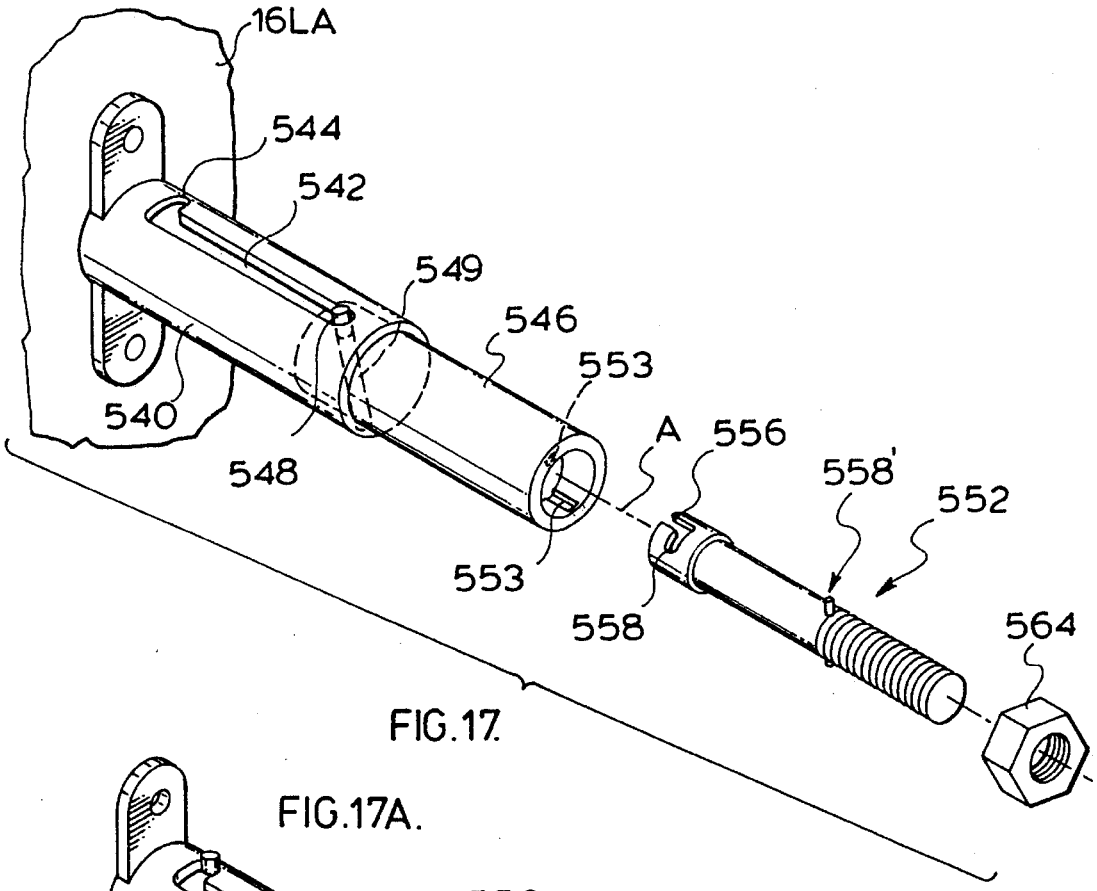
FIG.17.
FIG.17A.
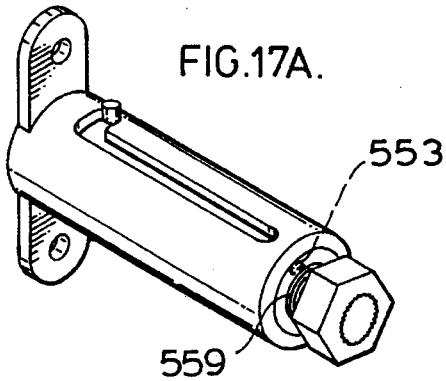
FIG.18.
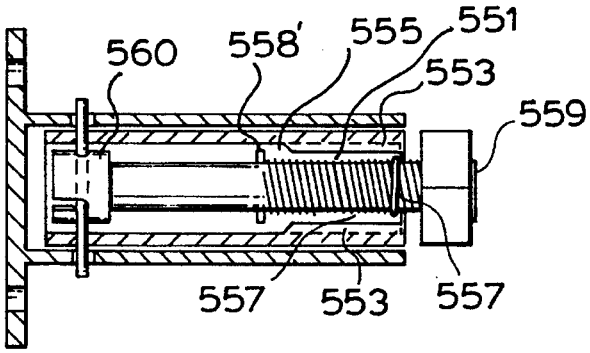

602
626
640
646
606
652
606R
638
648
648
646
628
650
652
600
642
633
676
676
658
654
615
606L
602
634
660
656
604

SIGN SUPPORT STAKE

This application is a Continuation-in-Part of application Ser. No. 08/223,231 filed Apr. 5, 1994 now U.S. Pat. No. 5,489,076 which is in turn a Continuation-in-Part of application Ser. No. 08/093,660 filed Jul. 20, 1993 now U.S. Pat. No. 5,340,065 which issued Aug. 23, 1994.

In this application: a 'stake' (usually of steel) is the portion of the sign assembly which is driven into the earth; a 'sign support' is mounted on the stake to be supported thereby; and the sign support is designed to support a 'sign'. The sign support will comprise an 'upright'and 'cross-bar' and the upright will usually have upper and lower swingably connected consents.

The invention relates to a stake(anticipated to be made of iron or steel), designed to be driven into the earth and when so driven to support the upright of a sign support post in approximately vertical orientation. The invention also relates to the combination of such a support post and such stake.

The contemplated use of the invention is with real estate signs but the invention is equally effective with other types of sign.

In U.S. Pat. No. 5,340,065 and application Ser. No. 08/223,231 there is described a sign which includes an upright and a cross-bar and which may assume an erected position where said cross-bar and upright are mutually perpendicular and a collapsed position where said members are parallel for transportation and storage. In addition to those aspects of the sign which claim priority by virtue of their Continuation-in-part status, the contents of U.S. Pat. No. 5,340,065 and of application Ser. No. 08/223,231 are incorporated herein by reference.

The sign may be of the type discussed in the previous paragraph but may differ therefrom in various respects to the extent discussed below.

By 'stake' wherein I mean the longitudinally extending member which is customarily driven into the ground to support the sign upright. The 'stake' will, in most applications be made of metal and the metal will usually be steel.

In one aspect of the invention the stake is provided with level indicating means which indicate when the stake is vertical. The stake in accord with the invention, will couple to the sign upright in such a way that when the stake is substantially vertical, the upright is substantially vertical. This is very important to the sign's appearance. Since the stake has substantial weight as does the driving element, the user, particularly if of light build and modest strength, will have great difficulty in driving the stake into the ground with the required vertical orientation without a guide indicator.

Accordingly in one aspect of the invention the stake has level means for indicating its level means to approximately vertically orient the stake. It must be noted that although vertically aligned before driving, after the stake is driven into the ground, the results of manual driving will cause the driven stake to deviate to some degree from the vertical. However the final result, and the resultant appearance of the sign will be improved because the level was initially used. The level may be of any suitable form but I prefer to use either a spirit level or a pendular type with an indicator.

In a preferred form of this aspect of the invention, the upright includes a downwardly open tubular member and the stake is provided with spacers adapted to slidably guide and then to position the upright when the latter is slid downwardly thereover. Hence the levelling means is preferably located to be located inside said tubular member when the latter has been slid into position.

In another aspect of the invention, jack means are provided to provide assistance in the removal of the stake. The stake having been driven into the earth to remain there for varying amounts of time, may be extremely difficult to remove. Many personnel using such signs will be of modest strength. Even robust men cannot provide the 600 pound extraction force sometimes required. Accordingly, this invention provides a jack to assist such removal. The jack includes a standard having a base adapted to rest upon the surface of the earth and providing, adjacent the top of said standard, a pivot axis, approximately horizontal, on which is pivotally mounted a lever, having a long and a short end. The manual force is manually applied at the long end. The short end is provided with means adapted to couple to the stake to apply raising force thereto. Preferably the coupling means comprises a hanging tensile member having means for connecting the lower end of the tensile member to the stake at the location to provide, on manual operation, the required upward pull. Means are preferably provided for altering the mechanical advantage of the lever to adjust to the strength of the user and to the required extraction force. In a preferred form of this aspect of the invention, the lever is provided with two or more tensile member suspension points at differing lengths from the pivot axis, so that, by changing suspension points the mechanical advantage of the level may be adjusted, it may also be adjusted by providing the lever with more alternatively selectable potential pivot axes, whereby the relative length of the arms may be changed to alter the mechanical advantage. In another aspect, the hanging member is a serially linked chain. Means are provided on the stake for coupling to the chain. Where the means are a projection, the length of the hanging member may be adjusted as desired, by correctly selecting the link for attaching to the jack on the projection. Of similar effect is the provision of a hook on the lever for attachment of the upper end of the chain by insertion of the hook in a selected chain link. By correct selection of the chain length the most effective chain length may be selected for best 'pull'. Preferably, also, the hook may be provided with two or more hook bights offering a selection of different lever arm lengths.

In another aspect of the invention the stake is provided with a heater. This is a very material advantage if the earth is frozen when it is desired to remove the stake. The heater acts to melt the earth which is in contact with the stake, providing a relatively low frictional force resisting the withdrawal. The heater must be provided with electrically accessible terminals on the stake, located above the earth when the stake is driven therein. These terminals should be designed for energization by a ready source of power, of which the best candidate is thought to be a pair of automobile jumper cables connected to the auto battery. Preferably therefore the terminals are projections from the stake to which the jumper cables may easily be attached. It is intended in most forseeable situations, to leave the heating element in place. Hence the stake, which is supplied with spacers to guide and support a tubular upright, is designed so that the element and terminals will be within the tubular upright when the latter is in place, (i.e. they will not interfere with its sliding onto and off of the stake).

In another aspect of the invention, means are provided to inhibit the removal of the upright from the stake. It is not economically feasible to design a 'theft-proof' connection between the relatively valuable sign and the stake which is anchored in the ground. However it is relatively easy to provide means which will prevent the casual lifting of the sign support off the stake. One example of such inhibiting means is a shank threaded through aligned bores in the overlapping portions of the stake and upright. Means are provided so that the shank may be locked in place with a simple padlock.

Alternative inhibiting means involves the provision of a catch on the tubular member, which is depressed to allow the tubular member to slide downwardly into position on the stake but which then springs back to prevent raising of the tubular member. Simple but non-obvious means are then provided for depressing the catch when the tubular member is to be removed.

It is a further aspect of the invention that the elements which form part of the invention are (in their state for carrying or storage) preferably made of approximately uniform length. It is an advantage if such length is no more than the length which will fit comfortably into a car trunk. It is still a further aspect of the invention to provide a convenient carrying case preferably water proof for the upright, the cross-bar and the stake. In the preferred form of the invention the upright has two pivotally connected sections wherein the sections are connected to assume either an end to end erect position or a side-by-side collapsed position. In the side by side collapsed position, the length of the layer side-by-side member will be approximately that of the cross-bar and the stake, and the cross-bar upright connection will be such that the collapsed attitude of the cross-bar will put its ends into approximate coincidence with the ends of the upright sections and of the same approximate length between ends of the stake. Where the upright has only one section, and is pivotally connected to the cross-bar the connection is such that with the cross-bar and upright in side-by-side collapsed position, the respective ends of the two members are approximately side-by-side, and the distance between their ends, approximately that of the stake.

Figure 3:
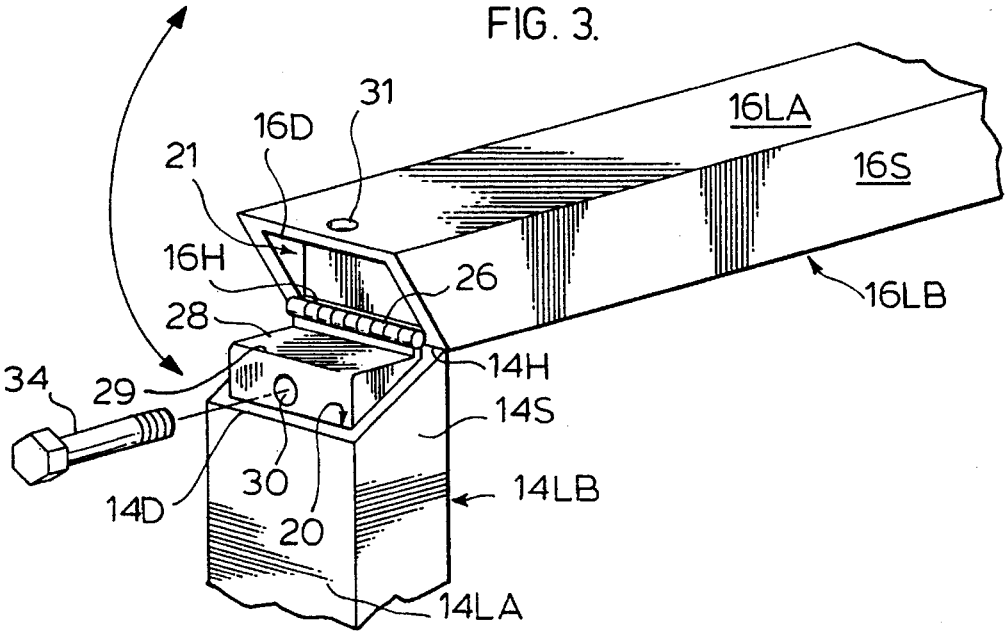
Figure 4:
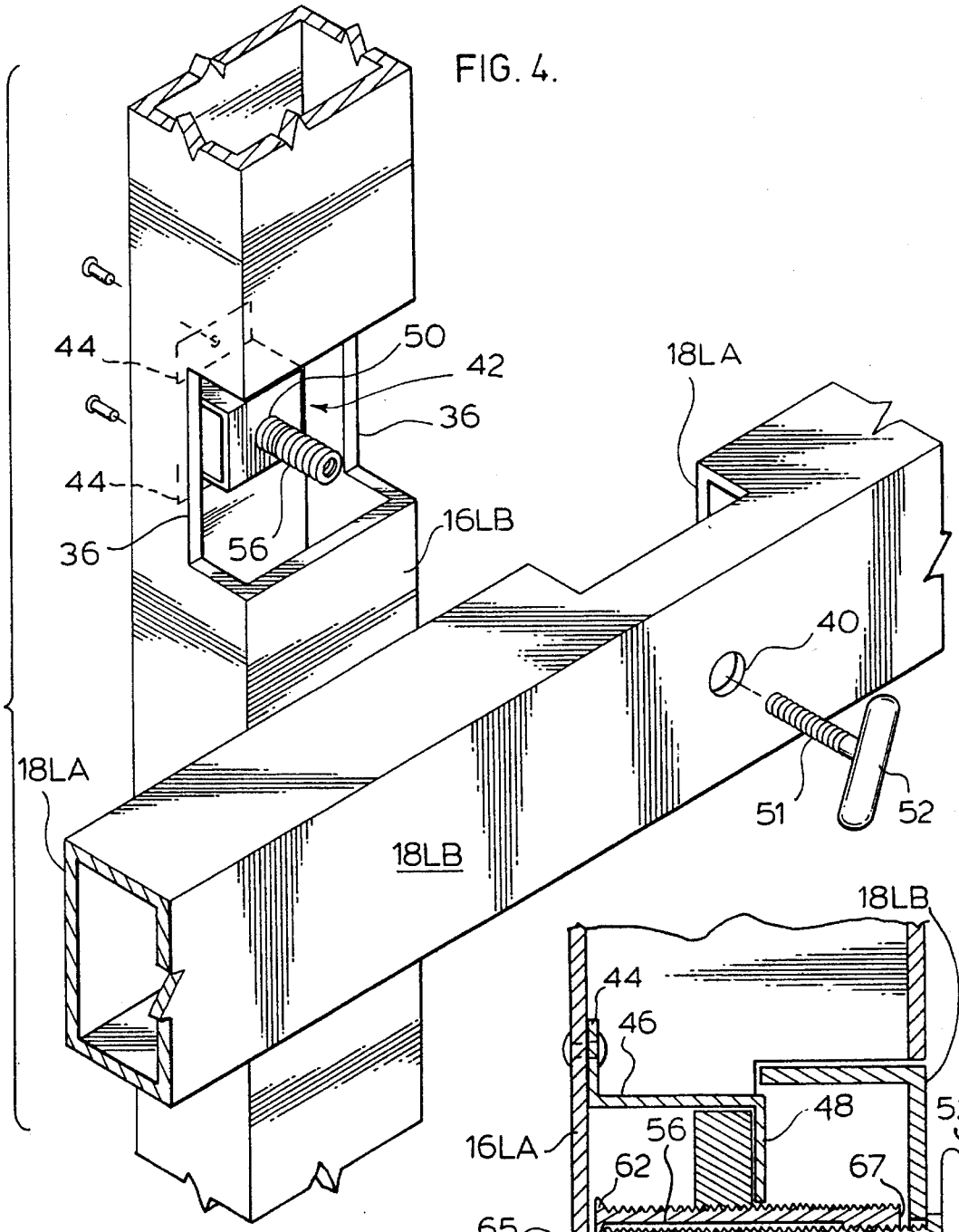
Figure 5:
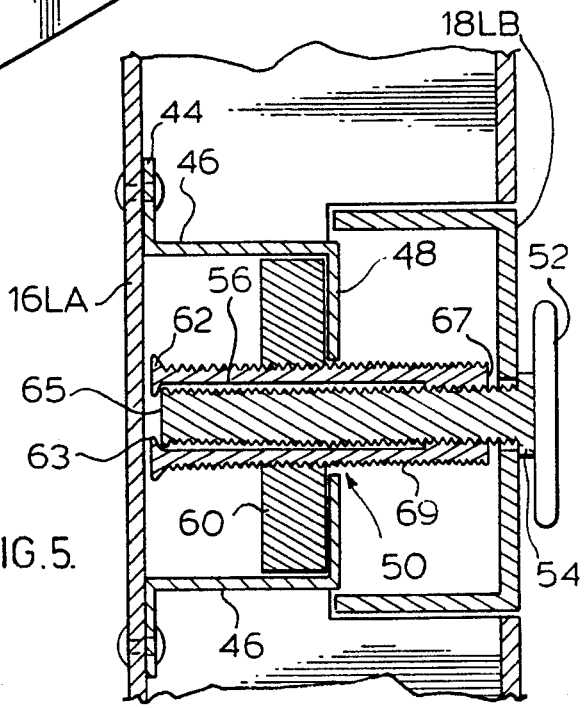
Figure 7:
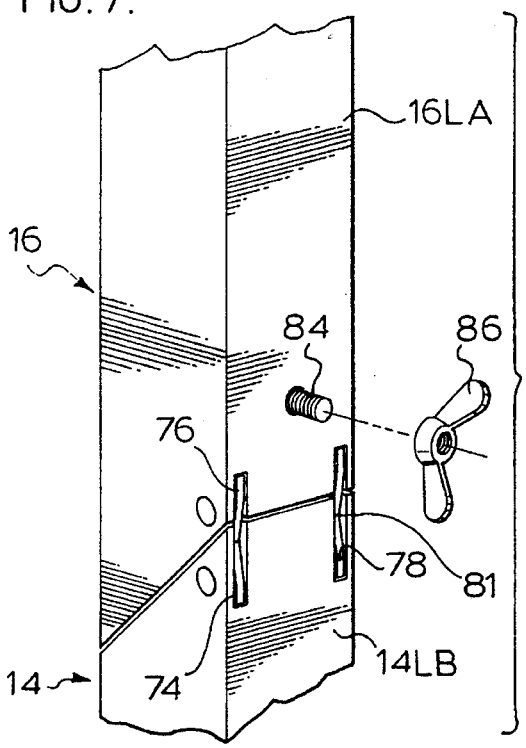
Figure 8C:
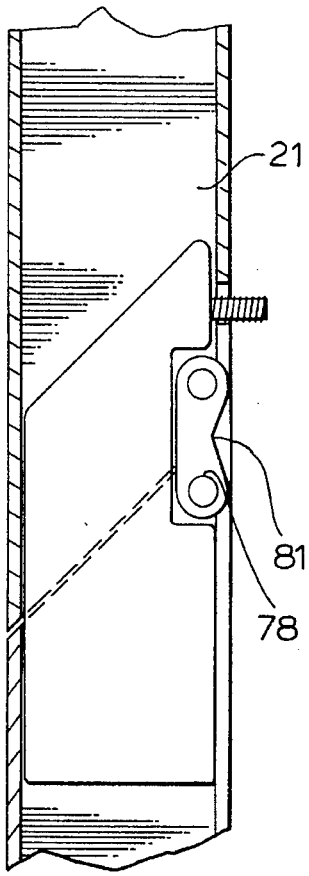
Figure 8B:
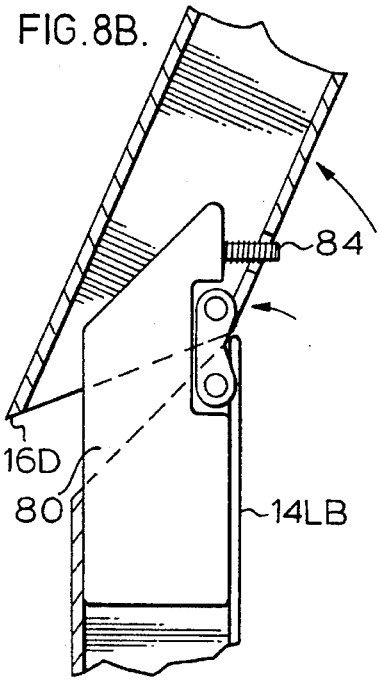
Figure 8A:
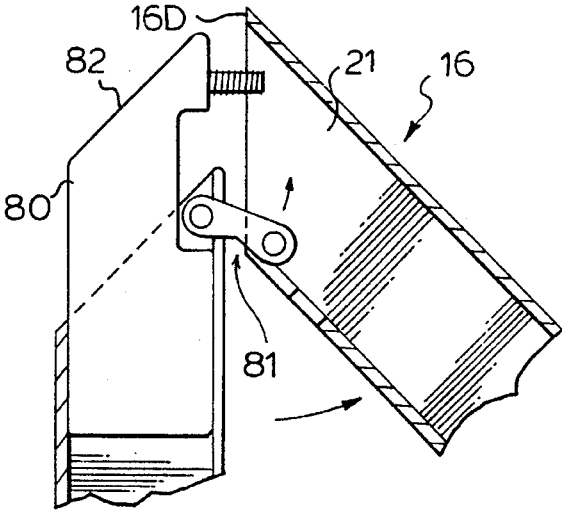

In drawings which illustrate preferred embodiments of the invention:

FIG. 1. is a perspective of a post support in accord with the invention with upper and lower extents in ERECTED position and the upper extent and cross-bar in PERPENDICULAR position, FIG. 2 is a perspective of the post support of FIG. 1 with the upper and lower extents in COLLAPSED position and the upper extent and cross-bar in PARALLEL position, FIG. 3 is a detail of the connection between the upper and lower extents, FIG. 3A is an alternate arrangement, FIG. 4 is an exploded detail of the connection between the upper extent and the cross-bar, FIG. 5 is a section of the connection of the upper extent and the cross-bar taken at right angles to the cross-bar, with the members in PERPENDICULAR relation, FIG. 6 is a section of the connection shown in FIG. 5, and from the same view point with the members in PARALLEL relation, FIGS. 5A and 6A show an alternate connection of the upper extent and the cross-bar, FIGS. 7, 8A, 8B and 8C show a swingable connection between the upper and lower extents which is an alternate to that shown in FIG. 3.

Figure 9:
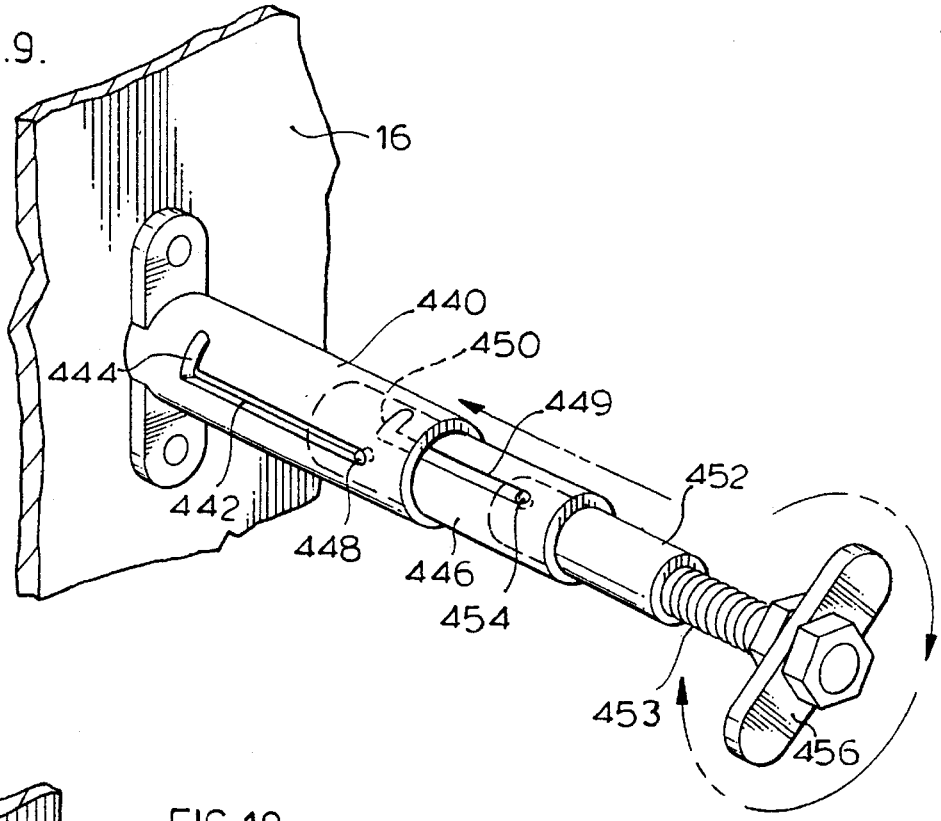
Figure 10:
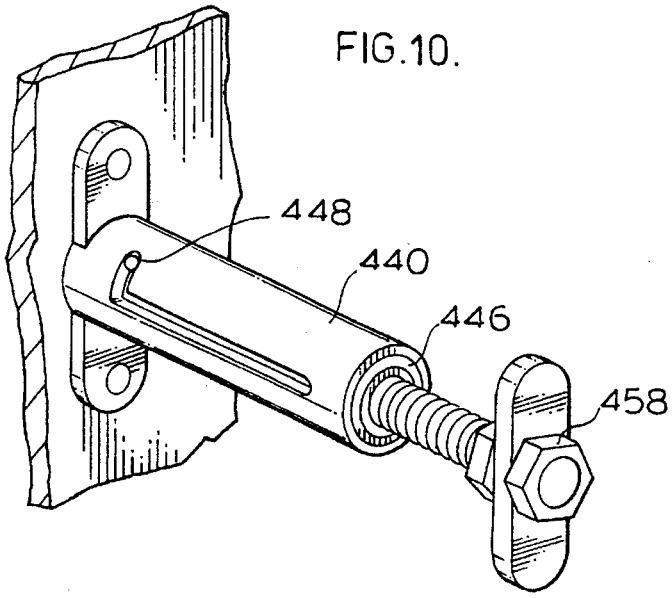
Figure 11:
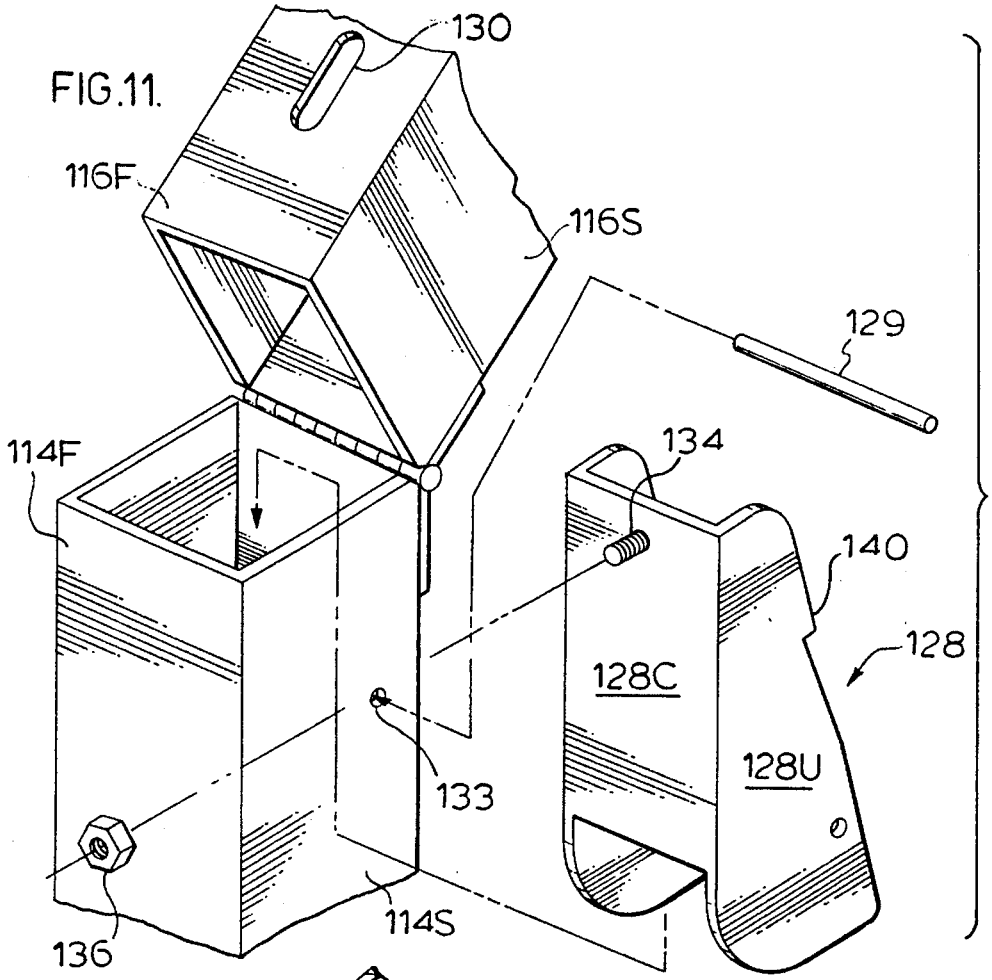
Figure 12:
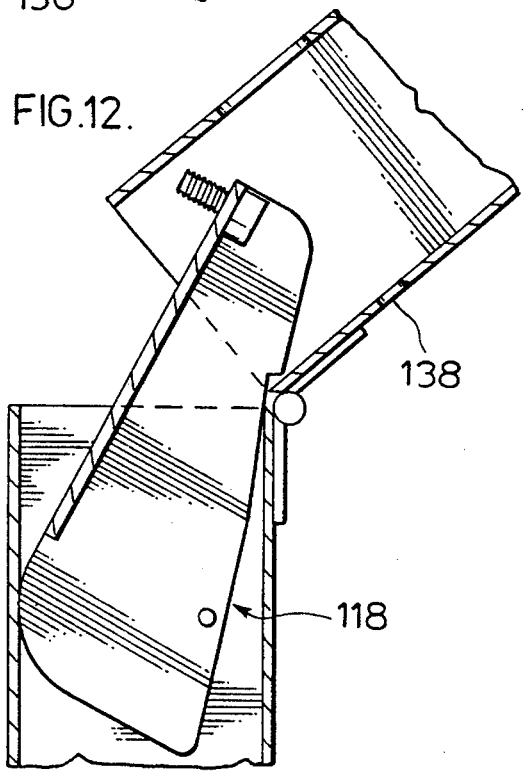
Figure 11A:
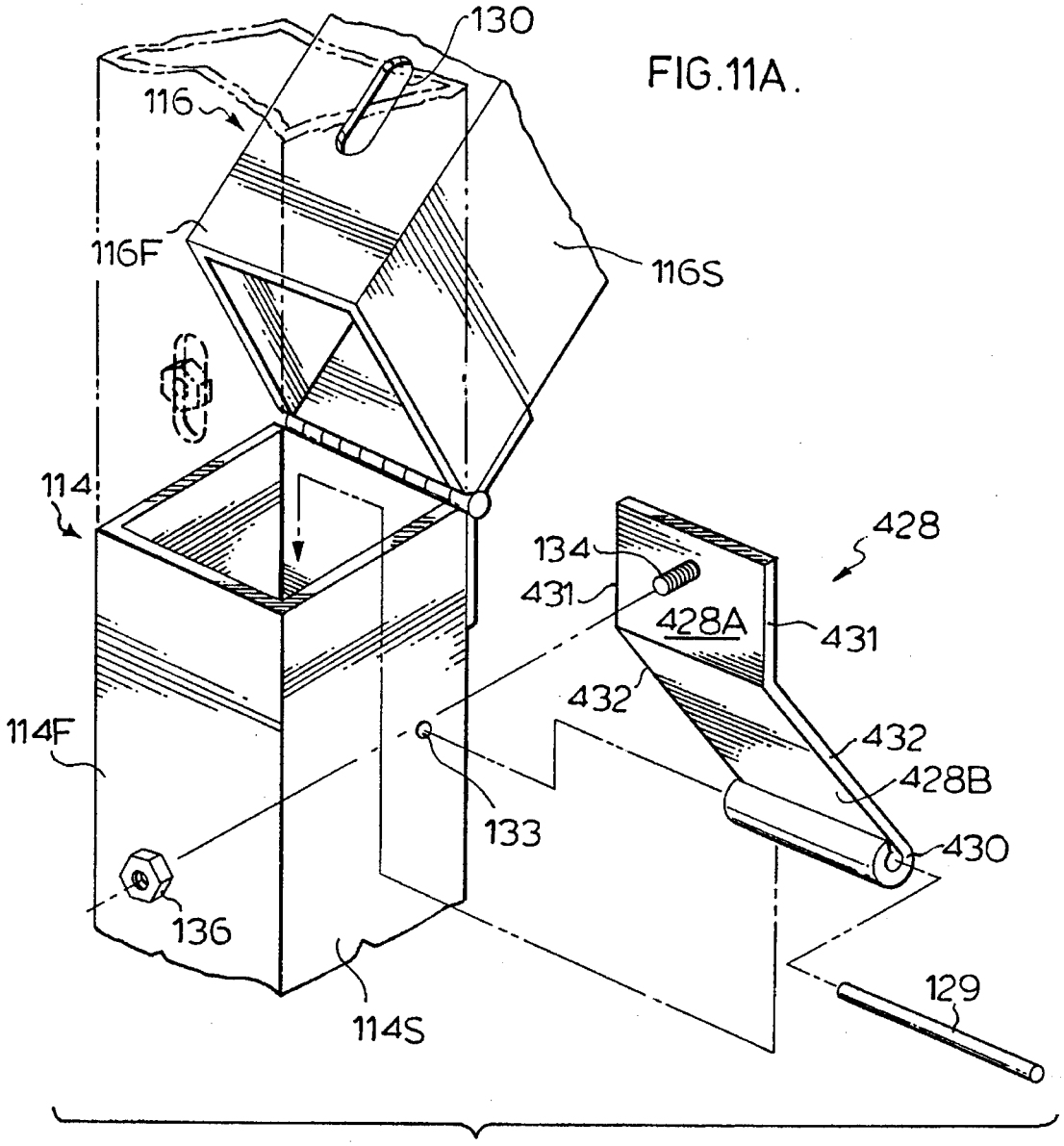
Figure 14:
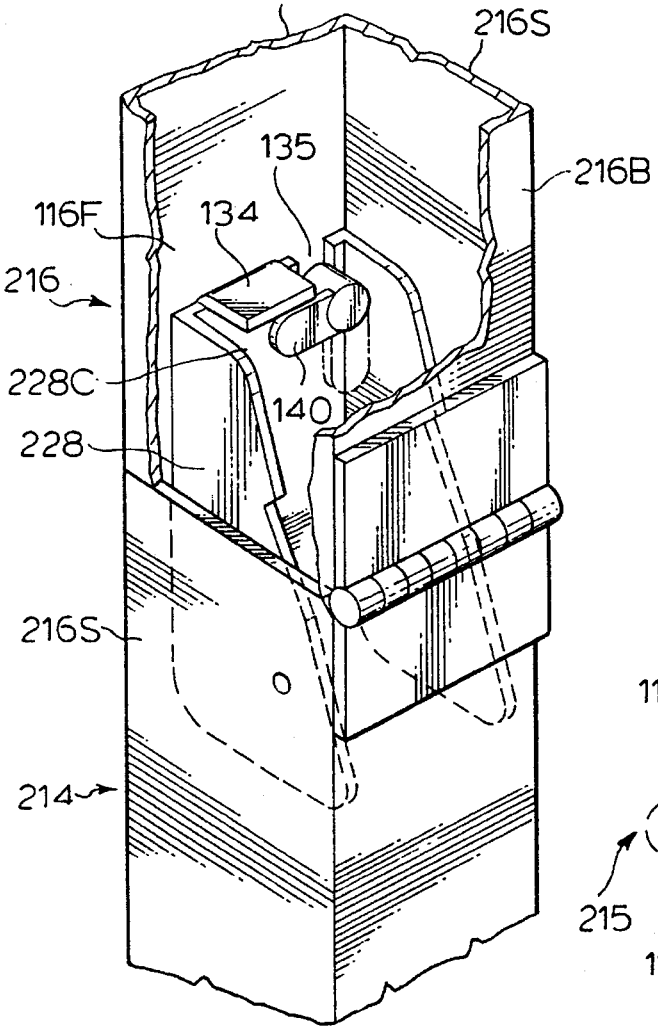
Figure 15:
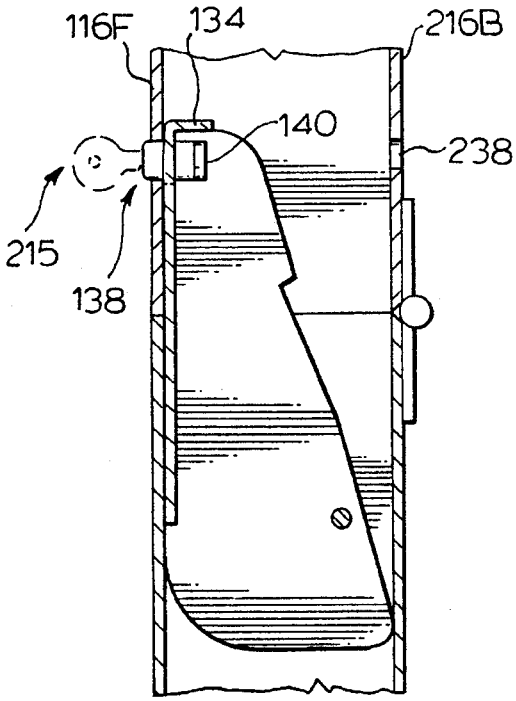
Figure 16:
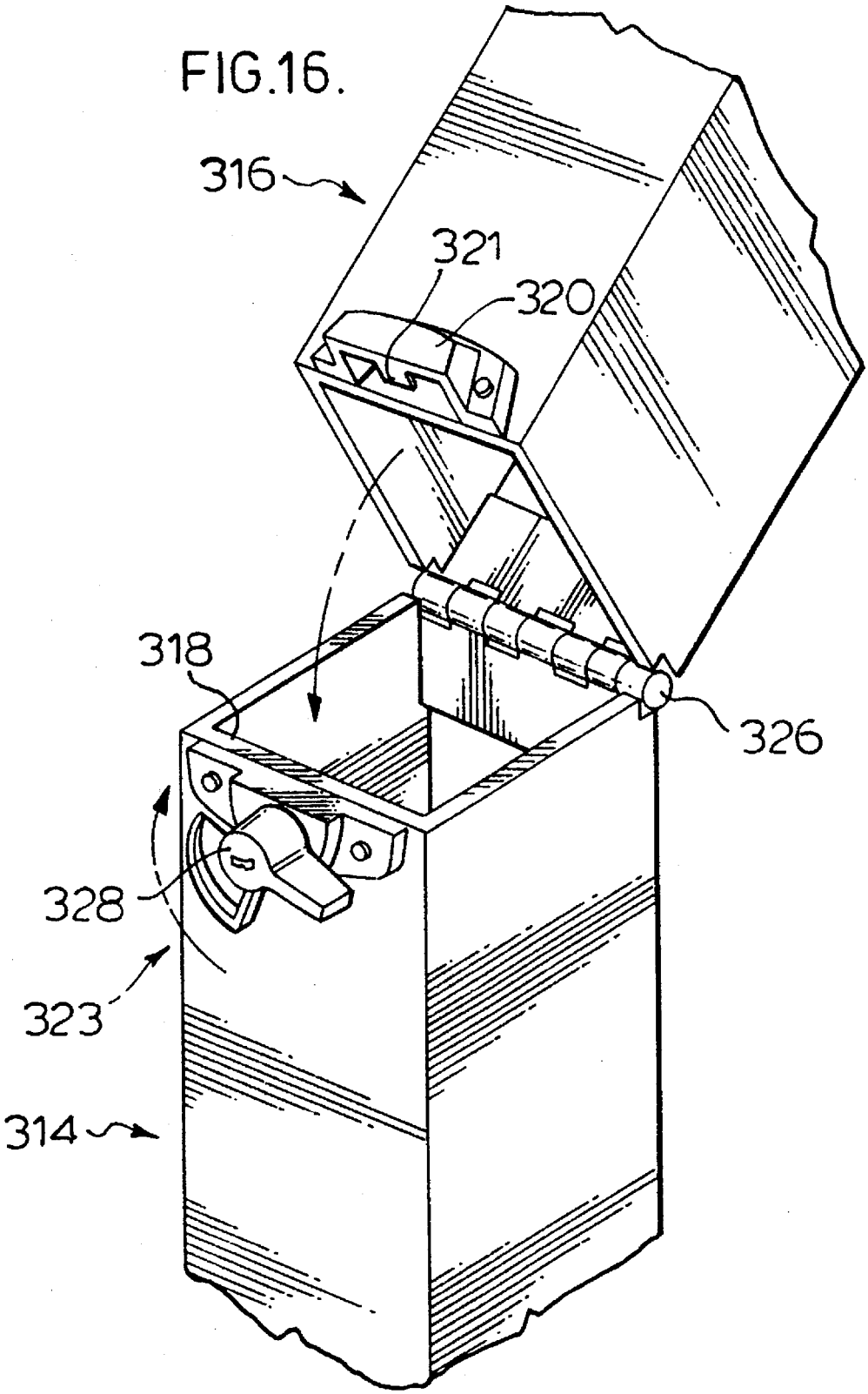

FIGS. 9 and 10 are partial, perspective views showing an alternate means for locking the cross-bar in PARALLEL or PERPENDICULAR relation, FIG. 11 is an exploded view and FIGS. 12 add 13 sectional views showing an alternate means for locking upper and lower upright extents in ERECTED position, FIG. 11A is a view of an arrangement alternate to, but similar to, that shown in FIG. 11, FIG. 14 is a perspective view and FIG 15 a sectional view showing a further alternate means for locking upper and lower upright extents in ERECTED position, FIG. 16 shows a further alternate means for locking upper and lower upright extents in ERECTED position.

Figures 19, 19A, 20:
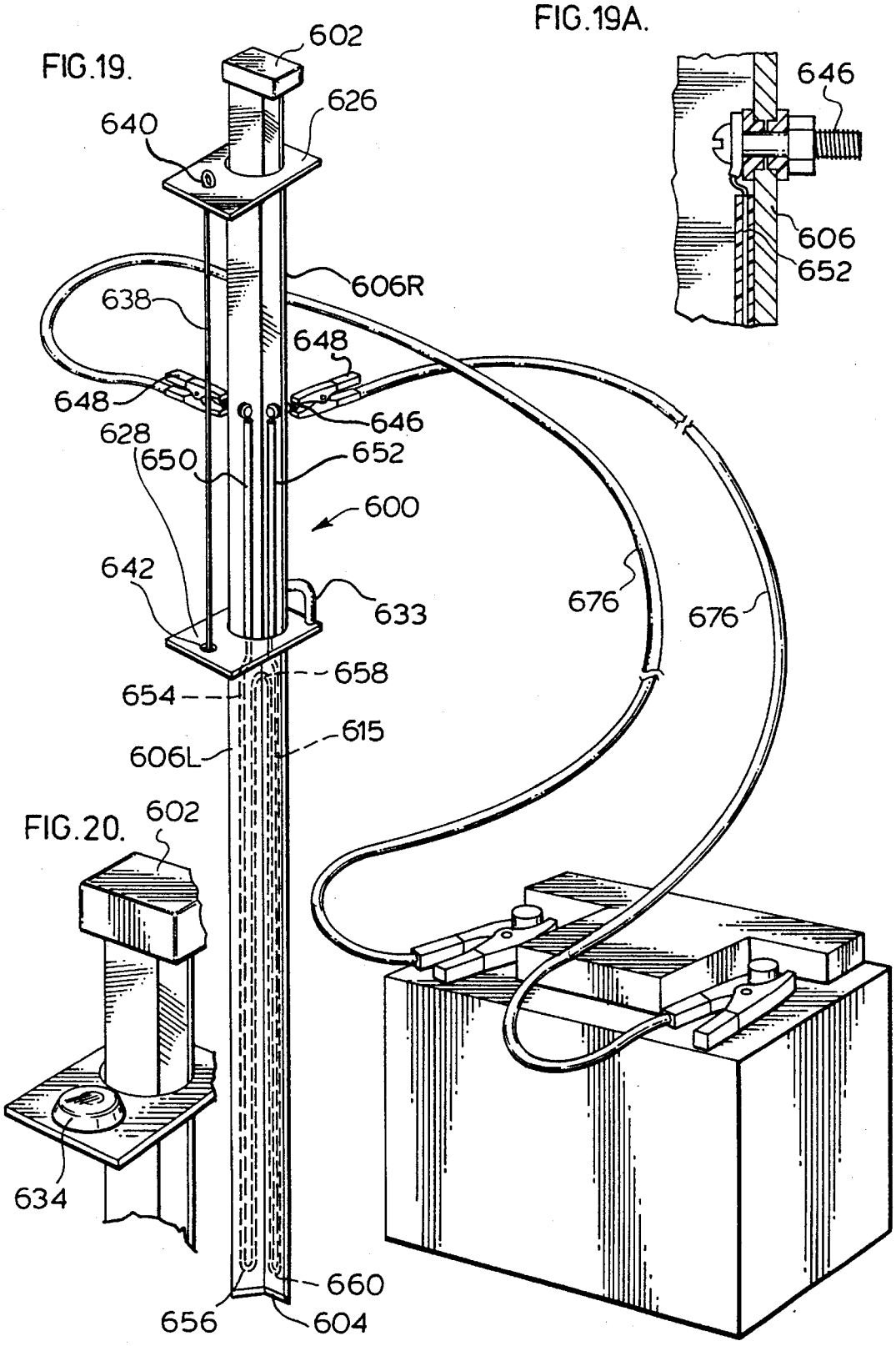
Figures 21, 23:
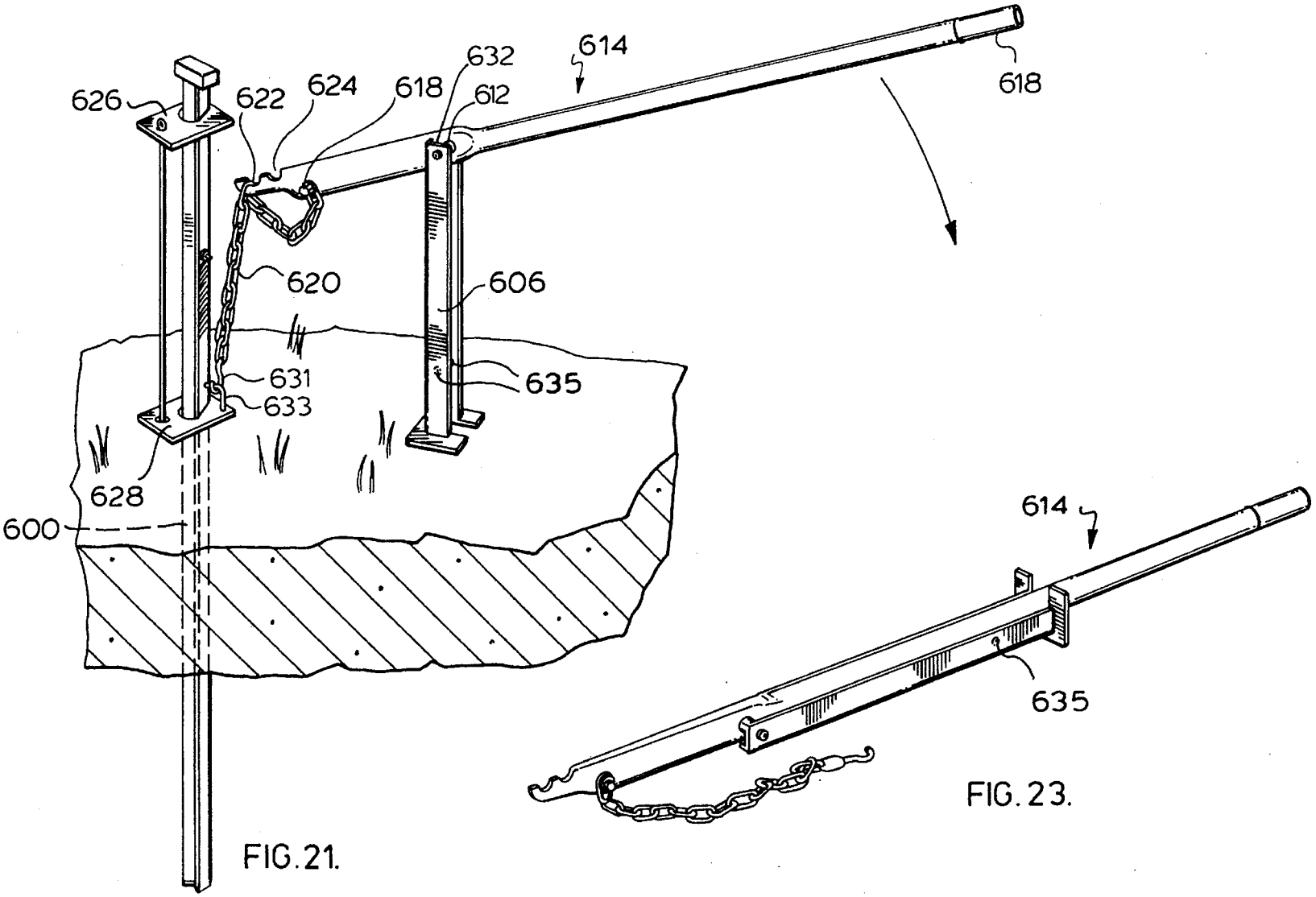
Figures 22, 24:
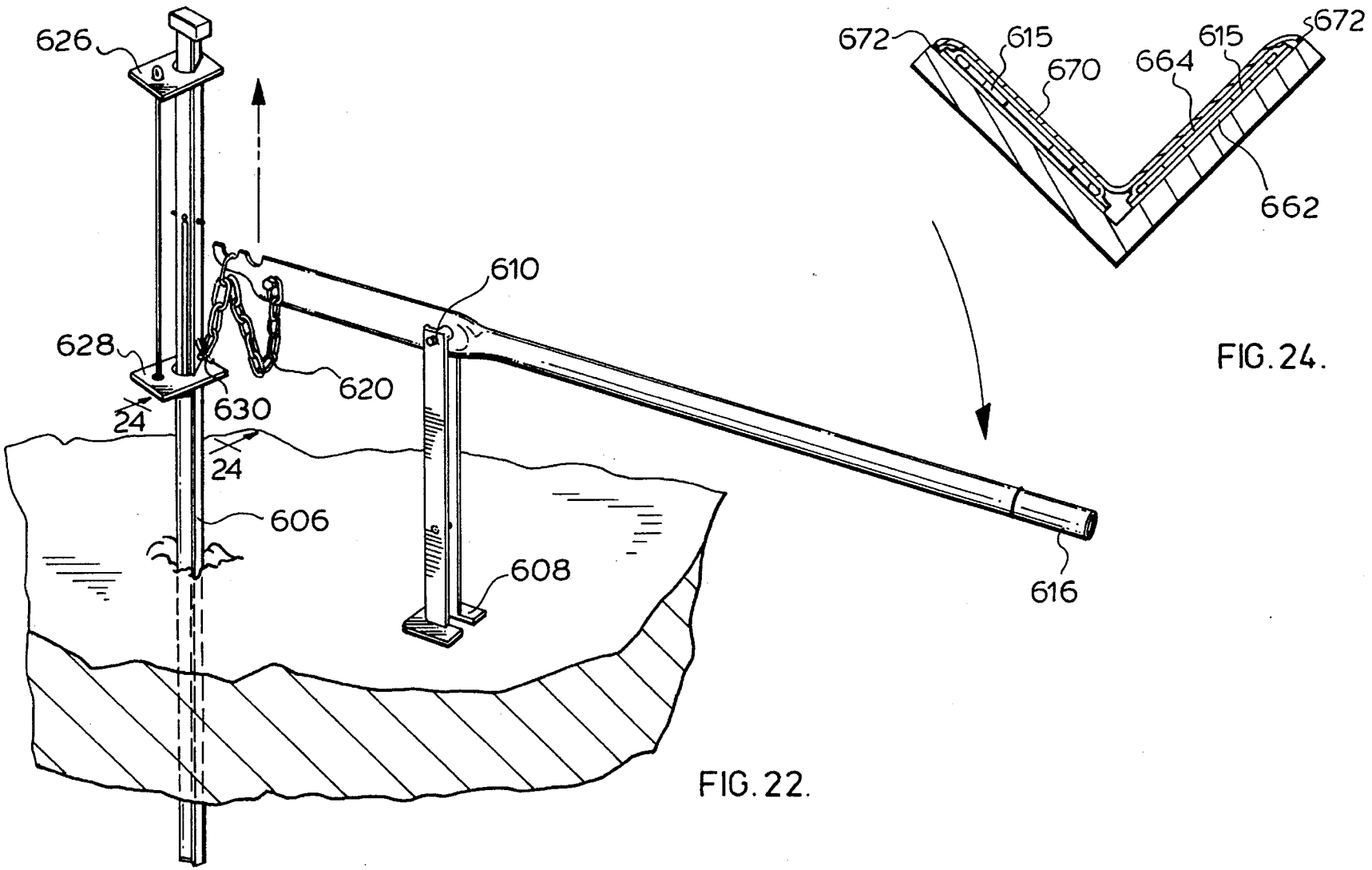
Figure 26:
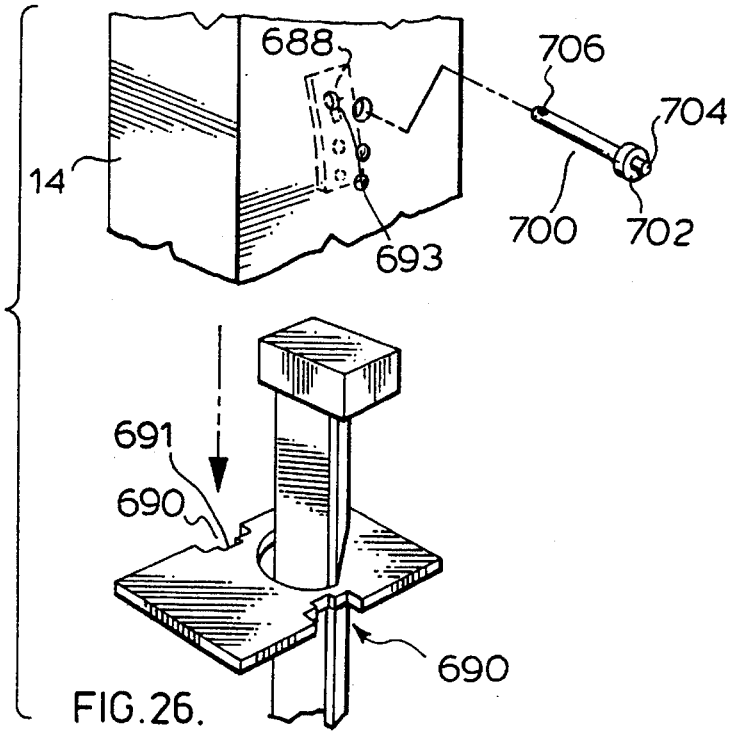
Figure 27:
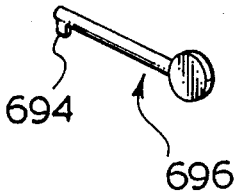
Figure 28:
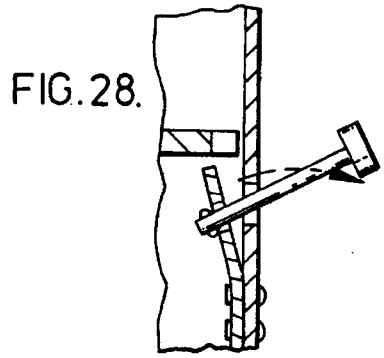
Figure 29:
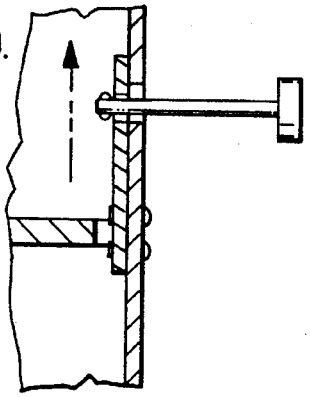
Figure 25:
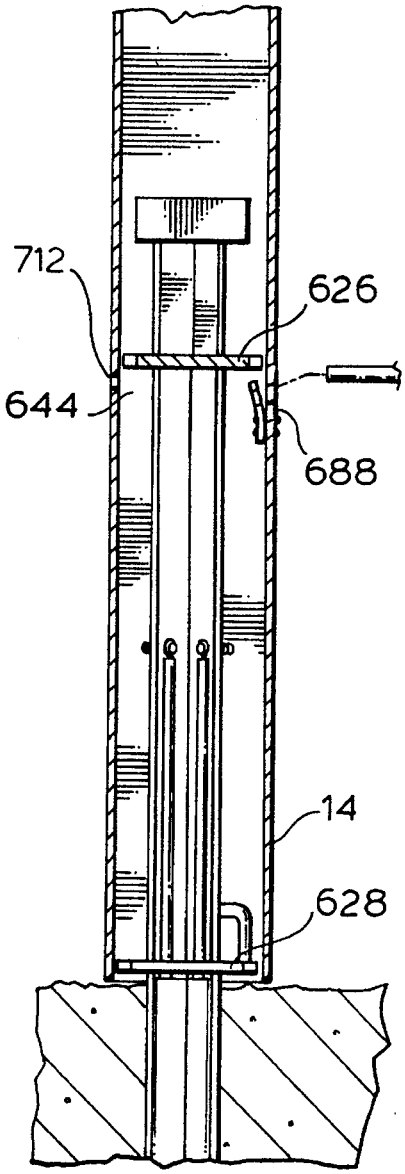
Figure 31:
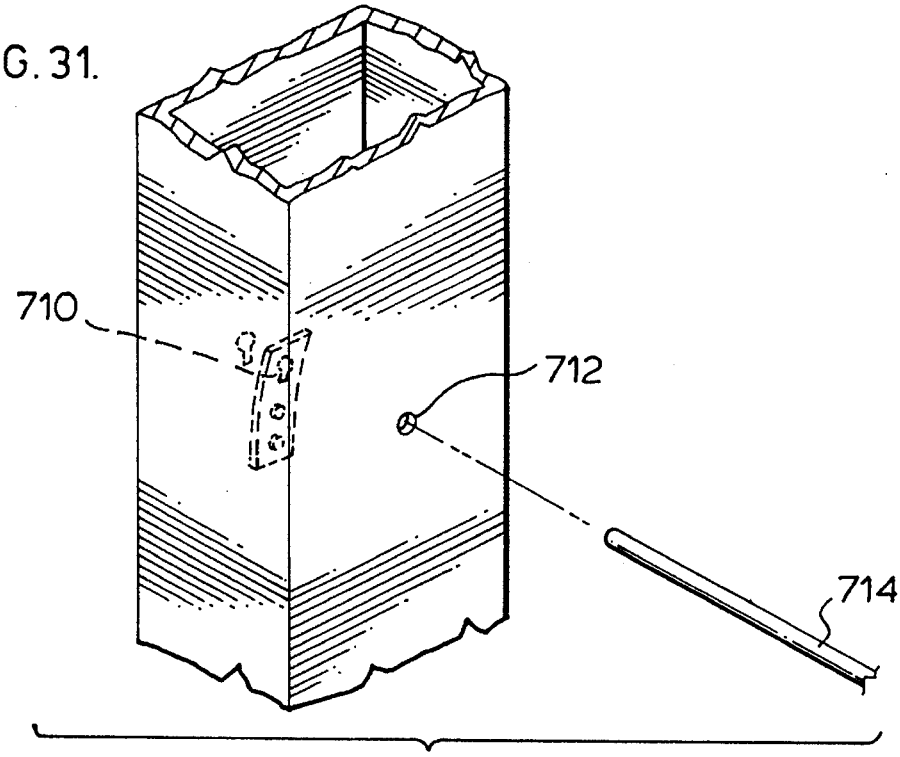
Figure 30:
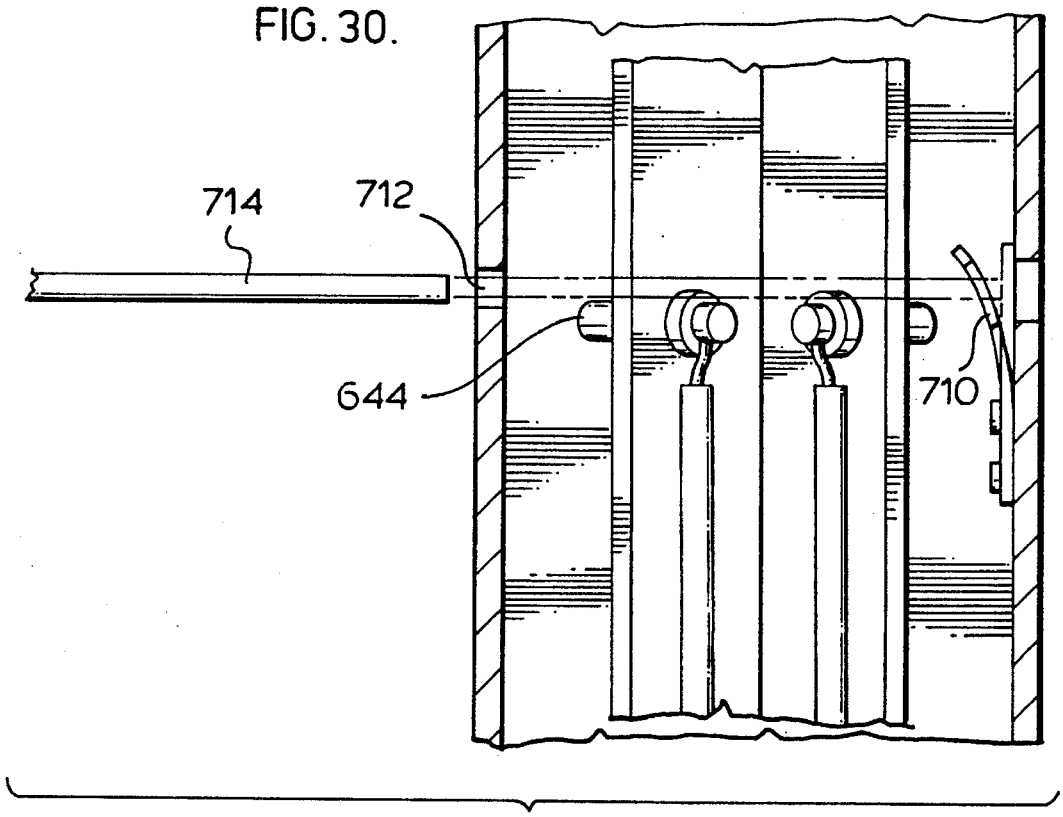
Figure 32:
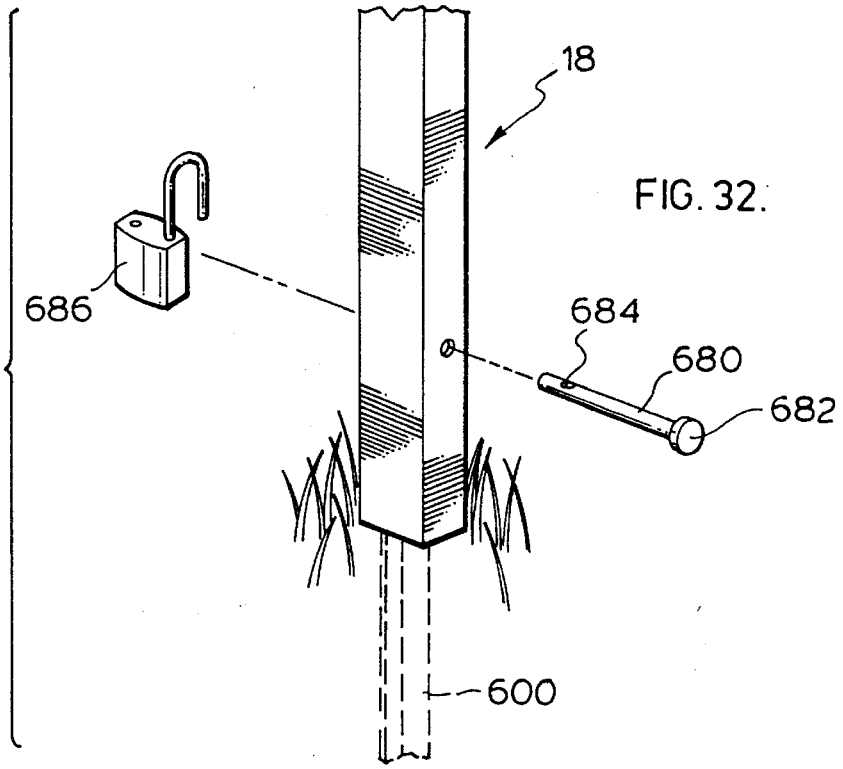
Figure 33:
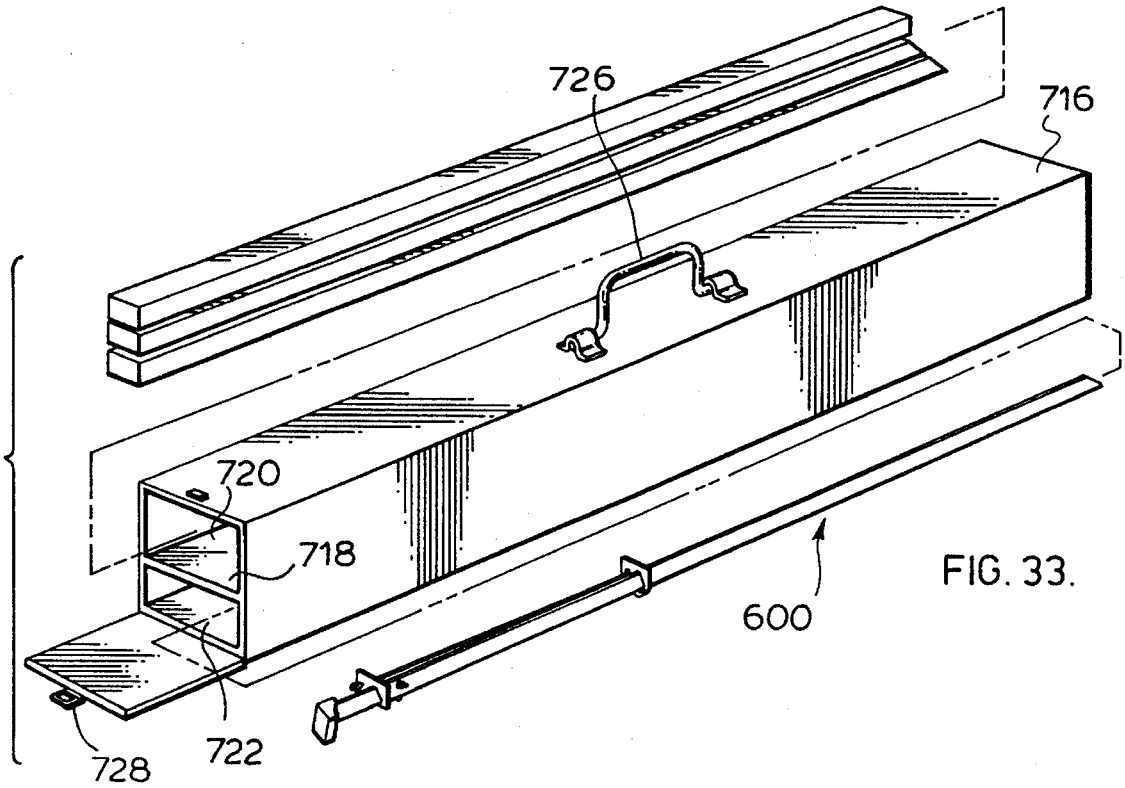

FIGS. 17, 17A and 18 show a further alternate form of connection between an upper extent and a cross bar, FIG. 19 is a perspective view of a stake in accord with the invention with heating means attached, FIG. 19A is a partial vertical section arranged to show the heater terminals, FIG. 20 is a partial perspective showing a levelling means alternative to that shown in FIG. 19, FIGS. 21 and 22 are perspectives showing the raising jack in use, FIG. 23 shows the jack collapsed for storage or transportation, FIG. 24 is an enlarged sectional view taken along the lines 24—24 of FIG. 22, FIG. 25 is a vertical section of a support upright in place on a stake, FIGS. 26 and 27 are detail perspectives of means for retaining the upright on a stake, FIGS. 28 and 29 show a method for releasing the upright from a stake, FIGS. 30 and 31 are scrap sectional and perspective view respectively of alternate means of attaching a support to and releasing it from a stake, FIG. 32 demonstrates inhibiting means to protect sign support removal by vandals, and FIG. 33 shows means for carrying or storing sign and stake.

It has been found convenient to first describe the sign support and, thereafter, to describe inventive improvements involving the stake.

In the drawings,the general arrangement is that a mounting member 10 is insertable in the ground surface defining an upwardly projecting shank 12 preferably of rectilinear section.

The lower extent 14, upper extent 16 and cross-bar 18 are preferably of: (a) tubular construction (b) generally rectilinear section and (c) aluminium.

Parameters (a) (b) and (c) are variable within the scope of the invention.

The members need not be tubular although some preferred aspects of the invention will require this.

A tubular section need not be rectangular. The inventive features may be applied to tubular section which are square, cylindrical or other shape. However, best connection of the upper and lower extents requires a rectilinear (which herein includes 'square') construction. This gives a pleasant appearance and an attractive aspect ratio.

The material may, in place of aluminium, be steel, plastic (if of sufficient strength and thickness) or of wood. Although wood, would not normally be conducive to forming in a tubular shape, it would be suitable where the tubular arrangement was not required.

In accord with the preferred embodiment the lower extent 14 defines a generally rectangular tubular passage 20 and the section of shank 12 is designed to make a close sliding fit therewith.

The lower extent, upper extent and cross-bar are, in the preferred embodiment, of identical section and provided with longer sides and shorter sides using the designation of the member with S and L, respectively, added. The lower extent thus defines shorter sides 14S and longer sides 14L. Each extent defines a longitudinal direction. The upper end of the lower extent is cut at an angle of up to 65° to the longitudinal direction along a plane perpendicular to the shorter sides, so that for angles other than 0° one of the longer sides 14LA is shorter in the longitudinal direction than the other.

The upper extent is, at its' lower end, cut in a similar manner, and at an angle to complement that of the lower extent, so that the two members may be placed end to end with their respective edges abutting. The members are pivotally joined by a hinge 26 defining a pivot axis parallel to the plane defined by the complementary edges and parallel to the longer side edges. The hinge 26 has its hinge plates (not shown) connected in any conventional manner to the respective abutting longer sides. It is within the scope of the invention to place the hinge connecting the short sides (so that the bevel and the sloping edges would slope from one short side to the other). However, a stronger hinge may be used and better connection achieved if the hinge connects the longer sides, as shown.

The hinge 26 is shown connecting the higher edge 14H of the lower extent to the higher edge 16H of the upper extent. However, it is within the scope of the invention to have the hinge connect the lower edge 14D of the lower extent to the lower edge 16D of the upper extent.

A core 28, which may be of wood, is designed to be snugly received in the tubular passage of one of the members have passage 20. The core extends from the passage 20 a short distance beyond the sloping edges and out of the passage to be level with the higher of the edges 14H. The core 28 may be firmly affixed to lower extent 14 by any conventional means, not shown. Thus the upper extent 16 may be swung into ERECTED position relation to the lower 14 with its passage 21 snugly fitting over the core. An aperture 31in the longer wall 16L of the upper member aligns with a bore 30 in the core. A bolt 34 may therefore be inserted through aperture and into bore 30 to lock the members in ERECTED position.

I prefer to drill the wall 14LB opposite the bolt so that the bolt 34 may pass through opposed walls 16LA and 14LB and be fastened by a nut on the outside of wall 14Lb (not shown).

However, it is within the scope of the invention to provide merely a threaded bore 30 in the core to receive the bolt, as is done in furniture manufacture.

The bore and bolt are preferably transverse bud may be sloped if desired.

The core may equally be fixed in the upper extent and the lower member bolted thereto.

The location of the hinge axis must be related to the degree of projection of the core, to ensure that there is no interference during pivotal operation of the extents while maintaining a snug fit with the other members when it is attached. As shown I prefer to locate the hinge at the meeting of the upper and lower extent edges and to terminate the projection of the core opposite the hinged edge.

It will be noted that with the single hinge of FIG. 3 the projecting edge 29 of the core, remote from the hinge has a height, relative to the hinge 26 which is limited by the necessity to avoid interference with edge 16D during relative pivotal movement of the members.

The point may be emphasized and an alternate embodiment shown in FIG. 3A which shows tubular lower and upper tubular extents 14A and 16A, respectively. These terminate in edges 14AD and 16AD which are each perpendicular to the longitudinal extents. The core 28A is affixed in any conventional manner to lower extent 14A and projects above edge 14AD and hinge 28A for snug reception in passage 21A. It is noted that for this to occur the core must be chamferred at 46 to allow passage of edge 16AD. Aperture 31A and bore 30A allow use of a bolt to fix the members in erected position.

The core 28 may be replaced by a reduced upper section of member 14, formed by swaging or conventional working of its wall extremities, with the reduced upper section being shaped to be slidably received in member 16, provided with a bolt aperture such as 30, and shaped to allow opening and closing movement of member 16. Equally the core 28 or reduced section may be part of section 16 and project into section 14 in closed position.

However the question of such interference is avoided and the core may be lengthened, thus strengthening the joint in ERECTED position by replacing the single hinge of FIG. 3 with the articulated links 78 shown in FIGS. 7 and 8A–8C. As shown side 14LB is provided With a pair of slots 74 extending parallel to the longitudinal direction of the member to its upper edge. In the ERECTED position of the member these slots align with slots 76 extending parallel to the longitudinal direction of side 16LB to its lower Each part of aligned slots 74–76 is adapted to receive links 78 which are pivotally connected to these members along axes parallel to the wide dimension of the tubular member. As shown in FIGS. 7 and 8A–8C, the links allow the provision of a larger projection of core 80 from its attachment to lower extent without causing interference with the upper extent as the latter swings into position. The provision of a larger projection together with a snug fit between core 80 and the upper extent 16 provides a more rigid joint in the erected position. As shown the core 80 preferably extends to an end face 82 which is parallel to the angle of the ends of the upper and lower extents. The projecting surface of the core which faces the direction of the link is provided with a projecting bolt shank 84 fixed thereto. The upper extent, just above its lower edge 16D is provided with an aperture 85 in wall 16LA adapted to receive the bolt shank 84 to project outside the wall in the erected position for application of a nut 86 thereto. Thus, with the arrangement as demonstrated in FIGS. 7–8A–8C the members 14, 16 may lie side by side in the COLLAPSED position with core 80 projecting from member 14. When desired for use, extent (FIG. 8A) is swung toward the ERECTED position, the links 78 allow the edge 16D to clear the core, the core to be snugly received in the passage 21 of extent 16 and the aperture to receive the shank 84 when the complementary edges of members 14 and 16 are abutting. A nut may then be tightened on shank 84 holding the members 14–16 firmly in erected position. (The shallow V cut out 81 in each link 78 allows a perfectly flat fold back of the linked members 14 and The upper extent near to its upper end is shaped to provide on one of its wide sides 16LB a rectilinear niche having parallel upper and lower edges along the narrow sides spaced as well as on side 16LB to receive a similar perpendicular tubular member therebetween and vertical edges 36 preferably half way between the wider sides. A similar arrangement is provided in a wide side 18LA of the cross-bar 18 so that the two members may be inter fitted in PERPENDICULAR attitude as shown in FIGS. 1, 4 and 5 with the wide sides of the crossed members having common planes due to the preferred interlock depth.

The niche may be more or less than one half the relevant thickness deep but the appearance and or the strength is thought to suffer.

It is within the scope of the invention to provide the niche in each of the cross-bar and upper extent narrower sides. However, the strength of the PERPENDICULAR connection between the cross-bar and the upper extent is believed much greater when the niches are cut in the wide sides of the members.

Returning to the preferred embodiment, the cross-bar wall 16 LB opposite the niche in one of the members is provided with a bolt aperture 40. Opposite the bolt aperture the upper extent is provided with a stirrup 42 comprising a bracket bearing ends 44 connected (by rivetting as shown, or otherwise) to spaced locations on the wall 16LA of the upper extent. Flanges 46 extend outward to support bridging strut 48 therebetween which is provided with an aperture 50 aligned with the aperture 40.

A bolt is provided with shank 51 extending through aperture 40 and has a head 52 attached and keyed to the outer end to allow manual rotation of the bolt. The bolt shank 51 is threaded but clears, loosely the edges of apertures 40 and 50. An enlargement 54 beneath head 52 bears on wall 18LB about aperture 40. A sleeve 56 is provided with internal and external threading, in the same sense. The inner threading is located only at an outer extent 58 of the sleeve inner passage, the rest of the inner passage being of wider diameter than the bolt. The inner threaded passage therefore receives the bolt with the bolt and passage threads meshed. The sleeve when threaded to the bolt extends inwardly loosely through aperture 50 in the bridging strut 48. A nut 60 is threaded into the inner end of the sleeve and is shaped to key against rotation on the flanges 46 of the stirrup. The inner end of the sleeve is peened outwardly at 62 so that its end cannot be screwed completely through nut 60.

The inner end of the inner passage of the sleeve also has peening 63 extending into the passage to prevent passage therethrough of the inner end 65 of shank 51. The length of shank 51 is chosen relative to that of sleeve 56, so that end 65 will contact peening 63 (on relative inner travel of the shank) before the outer end 67 of sleeve 51 contacts the inner side of wall 18LB (see FIG. 5).

Thus, the bolt shank 51 extends through cross-bar wall 18LB and threads into inside passage of sleeve 56 and the outside threading of sleeve 56 extends through the strut of stirup and is threaded into nut 60. Nut 60 and the stirrup act as the nut shank referred to in the introduction.

The cross-bar 18 is thus permanently attached to the upper extent 16 and the members may be pivotted relative to each other about the bolt axis between PERPENDICULAR (when not interlocked) and PARALLEL positions as hereinafter described.

The stirrup, sleeve 56, bolt shank and head are dimensioned so that with the sleeve's maximum outward excursion relative to the nut 60 and the bolt at its maximum outward excursion relative to the sleeve the members may be arranged side by side in PARALLEL relation, as shown in FIG. 6, occupying twice the thickness, measured along the bolt axis of one of the members 16 or 18. The members may be clamped in their PARALLEL relationship in by tightening the bolt head 52 for transportation or storage.

When it is desired to convert the relationship of members 16 and 18 from PARALLEL to PERPENDICULAR arrangement, the bolt, if clamped, is loosened and the members are relatively rotated to PERPENDICULAR orientation and moved into interlocking relationship as shown in FIG. 5 so that their thickness in the bolt axis direction is that of a single member 16 or 18, as shown in FIG. 5. The bolt is then tightened. It matters not which set of intermeshing threading turns easier. If it is the bolt shank 51 and the sleeve inside thread, then this turning occurs until the shank end 65 contacts the inner sleeve peening 63. The sleeve will then turn in nut 60 until the members are clamped in PERPENDICULAR orientation. The inward bolt movement will equally operate if, initially the shank 51 turns with sleeve 56 and the sleeve rotates in the nut until the sleeve contacts the wall 18LA and the nut contacts the inside of plate 48 and then the bolt turns in the sleeve until clamping in PERPENDICULAR orientation takes place.

To return the PERPENDICULAR members 16 and 18 to PARALLEL position the bolt is rotated in the opening direction. If the bolt initially turns relative to the sleeve then this takes place until the bolt peening contacts shoulder 69 inside the sleeve, after which the sleeve rotates until the sleeve peening 62 contacts the nut 60 and the latter may contact the inner side of the plate 48. The effective bolt and sleeve length is then sufficient to allow separation of the interlocked members to allow their orientation to PARALLEL position and clamping. The device works equally if the sleeve rotates first relative to the nut until the peening 62 stops relative rotation and then the bolt rotates relative to the sleeve.

Cross-bar 18 is provided with hooks 70 to allow suspension of a suitable sign therefrom.

In overall operation with the upper and lower extents 14 and 16 in COLLAPSED position and the upper extent 18 in PARALLEL position (FIG. 2) the post support is erected as follows.

The ground support stake 10 is entered into the ground. The lower extent may then be mounted thereon by sliding over the projection 12 of the ground support stake. The upper extent may then be rotated into ERECTED position and fixed in place by placing bolt 32 into the core and tightening to the nut provided. The cross-bar may then be moved into PERPENDICULAR position and clamped as previously described.

It will be appreciated that the three operations:

(a) mounting the lower extent on the stake, (b) moving the lower and upper extents to ERECTED position, (c) rotating and clamping the cross-bar and upper extent in PERPENDICULAR position, may be done in any sequence. Afterward the requisite sign 72 is hung from the cross-bar.

Similarly, the conversion of a sign in use FIG. 1 to the storage version involves first removing the sign 72 from the hooks 70. The three operations:

(d) removing the lower extent from the stake, (e) moving the upper and lower extents to COLLAPSED position, (f) may the upper extent and the cross-bar to PARALLEL position, may be performed in any desired order.

With regard to the embodiment of FIGS. 5 and 6 it is noted that Stirrup 42 side walls (not shown) may provided extending between walls 46 to key to the nut 60 so that the nut is keyed on four sides.

With regard to the embodiment of FIGS. 5 and 6 it is noted that, if desired, the nut 60 may be affixed to, and/or an integral part of the stirrup and as such would be located in the position shown in FIGS. 5 and 6.

FIGS. 5A and 6A show an alternate arrangement to that shown in FIGS. 5 and 6. In FIGS. 5A and 6A, opposite the bolt aperture 40 the upper extent is provided with a stirrup 92 comprising bracket bearing ends 94 connected (by rivetting, or otherwise) to spaced locations on the wall 16LA of the upper extent. Flanges 96 extend outward to support bridging strut 98 extending therebetween which is provided with an aperture 100 aligned with the aperture 40. Flanges 96 are provided with slots 97A, 97B which extends from near the outer to near the inner end. The slots are provided with a right angled turn into an end extent 102A and 102B adjacent their inner end. The direction of the turn is in the sense of a clockwise rotation looking inward along the axis defined by apertures 40 and 100. A leaf spring 99 is associated with each slot, and may be a separate member or part of the flange 96 material and the leaf spring is adapted to bias a stub 108 in slot 97A or 97B into the end extents 102A and 102B. (It is noted that spring 99 assists in the smooth and efficient operation but is not essential.)

A bolt is provided with shank 51 extending through aperture 40 and has a head 51' attached and keyed to the outer end to allow manual rotation of the bolt. The bolt shank 51 is threaded but clears loosely the edge of aperture 40. A sleeve 106 is provided with internal threading to mesh with bolt shank 51 threading and the sense of the threading is such that clockwise (inward) rotation of boltshank 51 carries it into sleeve 106. The sleeve 106 is provided on its outer surface with stubs 108 adapted to ride in slots 97A and 97B. In operation the allowed travel of the shank 51 into the sleeve plus the length of travel of stubs 108 in slots 97A, 97B represents the change in transverse dimension between the PARALLEL and PERPENDICULAR position.

Accordingly, with the upper extent 18 and cross-bar 18 in the PARALLEL position the bolt head is loosened sufficiently that the members 16, 18 may be rotated to PERPENDICULAR position. The bolt head is then pressed inward causing sleeve 106 to carry stubs 108 to the inner end of slots 97A, 97B where leaf springs 99 cause the stubs 108 to move into the right angled extents 102A and B. The bolt head 51' is then tightened relative to sleeve 106 to move cross-bar 18 into fully interlocked position relative to the upper extent 16. The use of the bayonet mounting, stubs 108 and slots 97 represents a considerable time saving in sign assembly over the embodiment of FIGS. 5 and 6.

When it is desired to move the cross-bar and upper extent from PERPENDICULAR to PARALLEL position the bolt head 51 is first rotated counter-clockwise until peened end 65 strikes the sleeve shoulder 69. The sleeve then rotates counter clockwise with the bolt head, carrying stubs 108 out of end extents 102A, 102B against the bias of leaf spring 99 so that the stubs 108 may be moved to the outer ends of slots 97A & 97B. The cross-bar and upper extent members may now be moved completely out of interlocked position so that they may be relatively rotated to PARALLEL position and clamped in this position by a slight tightening of bolt head 51. Once again the use of the bayonet of FIGS. 5A and 6A saves time.

If desired the control 52 or 51' for bolt shank 51 may be welded thereto, or otherwise fastened.

There will now be described further alternative means which do not require central cores of FIGS. 3, 3A, 7 or 8A–8C.

Figure 13:
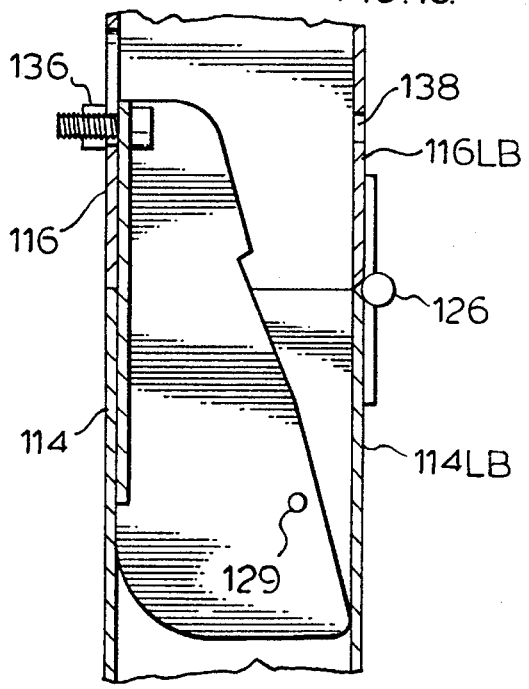

In FIGS. 11, 12, 13 there is shown a variant wherein a sign upright has a lower extent 114 and an upper extent 116 connected by a simple pivot means embodied by the hinge 126. Each extent 114 and 116 is of rectangular tubular form with respectively corresponding walls of the extents 114 and 116 co-planar with each other in the ERECTED position shown in FIG. 13. Thus, walls 114LB and 116LB are co-planar, and the hinge 126 connects these walls and defines a pivot axes parallel thereto.

A coupling member 128 is pivotally mounted by pin 129 in aligned apertures 133 (one, only, is shown) on opposed walls 114S of extent 114 to pivot about an axis 130 parallel to the axis of hinge 126 but displaced therefrom. The member 128 pivots between the coupling position shown in FIG. 13 where the extents 116 and 114 are in ERECTED position and the position shown in FIG. 12 which allows the extents to be rotated relative to each other toward collapsed position.

The member 128 defines a rectangular U shaped section when viewed along the mutual longitudinal axes of the extents. A wall 128C being the cross-bar of the U is designed to be parallel to and rest against the walls 116F and 114F in the ERECTED position, while the walls 128U forming the uprights of the U are in all positions parallel to and slide on respective extent side walls 114S of the lower extent 114 and side walls 116S of the upper extent Thus the three pairs of side by side walls at both lower and the upper extent contribute to the rigidity of the support in ERECTED position.

For detachably attaching the coupling member to the extent 116 in ERECTED position the wall 128C is provided with a threaded bolt 134 which projects through slot 130 in wall 114F in ERECTED position. Slot 130 must be sufficiently elongated to allow rotation of the coupling member into and out of ERECTED position. A nut 136 may be attached to the threaded bolt to secure it firmly in ERECTED position. The triangle formed by the nut 136, pivot axis 130 and that of hinge 126 rigidly and securely holds the extents in ERECTED position.

A pusher hole 138 is provided in wall 114B located to be opposite bolt 134 in ERECTED position so that a rod (not shown) may be used, if necessary, to push coupling member 128 to move bolt 134 through slot 130 when moving into ERECTED position. In addition walls 128U may be each provided with a cam extension 140 which projects toward wall 116LB aiding rotation of wall 116LB toward erected position. The weight of member 128 is also distributed, relative to pivot axis 130 so that with extent 114 upright, the member 126 is gravity; biased toward its ERECTED orientation through the last part of the arc of movement toward erected position In operation, with the support in ERECTED position as shown in FIG. 13, when it is desired to move to COLLAPSED position (which will be similar to that of members 14 and 16 in FIG. 2), nut 136 is removed. Bolt 134 is then pushed through slot 130 with the finger while the members 114, 116 are rotated toward COLLAPSED position. During such rotation the member 116 will carry bolt 134 and coupling member 128 to the position of FIG. 12 so the member 116 may move to COLLAPSED position. To move to erected position the rotation of member 116 toward ERECTED position with member 114 upright, first moves coupler 128 by contacting cam extensions 140. The gravity bias should then rotate coupler 128 so that bolt 134 projects through slot 130. If this does not occur then a rod may be thrust through pusher hole 138 to move bolt 134 through slot 130. The nut may then be applied to fasten the members in ERECTED position.

FIG. 11A shows a plate member 428 designed to perform the same function as the member 128 of FIG. 11. Plate member 428 has curled portion 430 for pivotally mounting the plate on pin 129. Member 428 has an upper panel 428A located to rest against wall 116F in the ERECTED position of member 114 and 116. Contiguous extending from upper panel 428A is lower panel 428B which in turn, contiguously extends into curled portion 429. Lower panel 428B, in the erected position of members 114 and 116, extends (in ERECTED attitude) diagonally upwardly from pin 129 to wall 116F below slot 130. Panel 428A mounts a bolt 134 with the same arrangement and function as bolt 134 in the embodiment of FIG. 11A. Opposed edges 431 of panel 428A and opposed edges 432 of panel 428B are adapted to move slidably along side walls 114S and 116S as the members 114 and 116 move between ERECTED and COLLAPSED position. Thus in operation, in the ERECTED position (see dotted outline) bolt 134 extends through slot 130 and is bolted to wall 116F by a nut. The members 114, 116 are maintained rigidly in erected position by: nut 136, pin 129 and hinge 126. The contact between the opposed edges 431 and opposed edges 342 and respectively opposed walls 114S and 116S adds (in both ERECTED position and in movements thereto and therefrom) rigidity to the assembly and reduces torsion stresses on the hinge 26 and pivot pin 129.

The operation of member 428 in movement of the members between ERECTED and COLLAPSED position is, in other aspects, the same as the operation of member 128 in the embodiment of FIGS. 11–13.

FIGS. 14 and 15 show an alternative arrangement where the upper and lower extents are hinged as in the previous embodiment. The body coupling member 228 and its pivot mounting is the same as coupler 128 of the previous embodiment. However instead of bolt 130 there is provided a horizontal flange 134 projecting inwardly from pivot 130. A key operated lock 138 is provided in wall 116F to be beside and just lower than flange 134. In ERECTED position the barrel of lock 138 rides in an upwardly opening slot 135 in wall 228C. A tab 140 is combined with the lock and adapted to project downwardly (dotted line position) when unlocked, and when locked (solid line position) to contact the flange 134. The tab 140 is spaced from wall 228C to allow wall 116F to rotate therepast when the lock is unlocked.

In operation with the members 214 and 216 in ERECTED position, and the lock locked, tab 140 will contact flange 134 preventing movement of extent 216 toward COLLAPSED position. To move the members to unlocked position the key 215 is used to unlock the lock and moves tab 140 to its vertical, dotted line position. The member 216 may then be rotated to COLLAPSED position and coupling member 228 will move clockwise in FIG. 15 sufficiently to allow such movement.

To move from COLLAPSED position to ERECTED position, member 216 is rotated with member 214 vertical, into ERECTED position. The coupling member 228 will move into coupling position initially under the impetus of the wall 216B and then under gravity or by a 'push' through pusher 238. Once the coupling member 228 is in place with its three walls against the three walls 216S, 216F and 216S it may be locked in place by key 215 in lock 138.

FIG. 16 shows a further method for detachably fastening the upper and lower extents in ERECTED position. These figures show a hinged connection 326 as in the previous embodiments defining an axis perpendicular to the longitudinal axes of upper and lower extent members 316 and 314 in the ERECTED position. The matching edges 320 and 318 of members 316 and 314 are perpendicular to the longitudinal axes of the member. As shown in FIG. 16 the member 316 mounts a window sash fitting 320 while the member 314 mounts a cooperating swivel 323 with its conventional spiral ramp. Thus the members, in ERECTED position have the swivel 323 engaging the tooth 321 in fitting 320, and, in combination with hinge 326 securely hold the members in ERECTED position. Preferably, as shown the swivel is provided with a key-operated lock 328 which, when set, holds the swivel in position. When it is desired to move the support to COLLAPSED position the key is used to unlock the lock 328 and the swivel 323 rotated to disengaged position. The upper extent 316 is then rotated to COLLAPSED position beside the lower extent 314. To move the members to the erected position the process is reversed.

If desired the window sash fastening may be replaced by a conventional fastener of the lunch-box type which is also susceptible to the addition of a key or combination lock.

The alternatives with window sash or lunch box locking means each provide a convenient fastening in the ERECTED position which is convenient and rigid and does not require the linkages, cores or coupling members of the other embodiments.

FIGS. 9 and 10 show means for connecting a sign cross-bar 18 with a support extent 16 which are an alternative to the connections, for the same purpose, shown in FIGS. 4–6 (a first variant) or in FIGS. 5A and 6A (a second variant). Both the first and second variants provide means for securely fastening the cross-bar 18 and support 16 in either PERPENDICULAR or COLLAPSED position. However both are slower than desirable by some user's because their operation involves screw action.

In the embodiment of FIGS. 9 and 10 a faster operating connection is described. In FIGS. 9 and 10 a sleeve 440 is permanently fixed on wall 16LA of the upper extent 16 to project toward wall 16LB (see FIG. 6). Sleeve 440 carries an axial slot 442 which has a right angled slot 444 at its inner end, here running clockwise looking inward from the inner end of slot 442.

A sleeve 446 is dimensioned to slide and rotate in sleeve 440. Sleeve 446 is provided with a stud 448 adapted to project from the surface of sleeve 446 and to ride in slots 442 and 444. Stud 448 is mounted retractable and spring loaded to projecting position and may be retracted to allow insertion, with its sleeve, in sleeve 440.

Sleeve 446 is provided with an axial slot 449 having a right angled turn 450 in an inward—clockwise sense at its inner end.

A third sleeve 452, is provided with a spring biased retractable stud 454, is inwardly threaded to receive threaded bolt 453 which may be screwed inward in sleeve 452 by clockwise rotation under the control of handle 456 which may be fixed on bolt 453 by any conventional means, such as the lock nuts 458 shown. The inward threading on sleeve 452 is provided with inner and outer rotation stops (not shown) for bolt 450. Bolt 456 projects through an aperture in wall 18LB as does bolt 51 in FIG. 6.

The combined axial movement of the studs in slots 442 and 448 approximates the change in transverse thickness of members 16 and 18 between PARALLEL and PERPENDICULAR position (compare FIGS. 5 and 6).

In operation, with the members in PARALLEL position, by analogy to FIG. 6, and bolt 456 sufficiently screwed to clamp them in this position, the movement to PERPENDICULAR position is performed as follows:

Bolt 456 is loosened so that the cross-bar 18 may be rotated 90° relative to extent 16 and the members are then moved into interlocking position (see, by analogy FIG. 5).

Bolt 456 is then moved axially inward until studs 448 and 454 move to the inward ends of the slots. The bolt 453 is then rotated clockwise and it is expected that the frictional drag of the bolt threading will move each stud into its respective right angled slot. If the frictional drag does not place the studs in the right angled slots, then the bolt will reach its inner rotation stop and positively perform the required clockwise rotation to place the studs in the slots. The cross-bar 18 is then securely locked in PERPENDICULAR relation to the extent 18.

For movement back to parallel relation the procedure is reversed, if the frictional drag of bolt threading does not move the studs out of the slots, the bolt will rotate to its outer rotation stop to positively move the studs. When the studs are again in the axial slots, they may be moved to the outer ends and the members separated from interlocked position, to be rotated to PARALLEL position where they may be clamped by tightening bolt 456.

The studs and slots may be reversed between interacting members but will require an opposite sense of bolt rotation for the same bolt direction. The right angle slots may both be directed in the opposite sense, but will require opposite bolt rotation.

The embodiment of FIGS. 9 and 10 will provide much faster erection and dismantling of the cross-bar than with the other alternatives or with previously known sign designs.

The hinges 26, 126, 226, 326 shown herein are mounted outside the extents to which they are attached. They may, alternatively, be mounted inside but, it is thought at more trouble and expense.

FIGS. 17, 17A and 18 show means for connecting a sign cross-bar 18 with a support extent 16 to allow movement of these members between PARALLEL and PERPENDICULAR RELATIONSHIP which are an alternative to the connections, for the same purpose, shown in FIGS. 4–6 (first variant), FIGS. 5A and 6A (second variant) and FIGS. 9 and 10 (third variant). All variants show means for securely fastening the cross-bar 18 and support 16 in either PERPENDICULAR or COLLAPSED position. The variant in FIGS. 9 and 10 was considered the fastest to use.

In the embodiment of FIGS. 17, 17A and 18 a fast operating connection is described. In FIGS. 17, 17A and 18A sleeve 540 is permanently fixed on wall 16LA of the upper extent 16 to project toward wall 16LB (see FIGS. 4 and 5 for analogy). Sleeve 540 carries opposed axial slots 542 which each have opposed circumferential slots 544 at their respective inner ends, here running clockwise looking inward from the inner ends of slots 542.

A sleeve 546 is dimensioned to slide and rotate in sleeve 540. Axis of rotation of rotation A defines the term 'axial' in this embodiment. Sleeve 546 is provided with opposed studs 548 adapted to project from the surface of sleeve 546 and to ride in respective slots 542 and 544.

Studs 548 form the extension of a pin 549 extending diametrically across the sleeve. Sleeve 546 has a wide bore 555 at its end nearer wall 16LA but the bore tapers at 551 adjacent the opposite end. In the tapering end 551 a pair of diametrically opposed grooves 553 are provided. The depth of such grooves 553 is not sufficient that they extend radially outwardly beyond the cylindrical projection of the wider portion of the bore.

A bolt 552 is designed to slide inside bores 555 and 551. The end of bolt 552 nearer wall LA is provided with an enlarged end 560 having an open recess with a short opposed axial slots 556 which terminate at their end nearer wall 16LB in circumferential slots 558 which project from respective slots 556 in a circumferential direction in the opposite sense to that of slots 544.

The end of bolt 552, adjacent its outer end is provided with opposed pins 558 designed to ride in grooves 553 when the sleeve 552 is at its most extended position as determined by head 560 contacting the narrowing of the sleeve bore toward restricted portion 551.

Bolt 552 is provided with an outer manual control knob 564 which maybe a nut fixed on the end of the bolt, To construct the assembly shown it will be noted that the bolt, without knob 564 may be slid inside sleeve 546 (without shank 548) in a direction so that its end projects out of bore 551. The sleeve 546 may then be inserted in fixed sleeve 540. The pin 549 may then be threaded or pushed through-sleeve 546 to ride in slots 542 and pin 549 may then be fixed in portion in any conventional manner leaving ends 548 riding in slots 542. The knob 564 may then be applied to the projecting end of bolt and fixed in place.

In operation, 56 with the members 16 and 18 in closed position (FIG. 17 and see FIG. 5 for analogy). To clamp the members in this position the knob 564 is moved toward wall LA until pin 548 and slots 556 receive pin 549. Pin 549 and bolt 552 then moves (with any necessary rotation supplied by knob 564) until shank ends 548 reach right angled slots 544, a continued clockwise rotation of knob 564 causes studs 548 to seat in slots 544 and pin 549 to seat in slots 558. The length of bolt 552 is selected so that it bears on wall 18 (see FIG. 5) to hold the members 16 and 18 in PERPENDICULAR orientation.

(The slots 558 and slots 544 could have been run in the opposite direction to achieve the PERPENDICULAR position clamping with a counterclockwise twist).

In the variant shown, when it is desired to move the members 16, 18 to PARALLEL position the knob is rotated counterclockwise to remove studs 548 from slots 544 and shank 549 from slots 558. The bolt may then be drawn to extended position with the pins 558' riding in slots 553 in bore extent 51 allowing members 16 and 18 to be drawn out of engagement and rotated to PARALLEL orientation.

Nut 564 is preferably provided with a short extent of threaded movement between mechanical limits such as burrs 557 and 559 in the threads. The limited movement is provided so that (in addition to allowing manipulation of bolt 552) the nut may be screwed to bear on the near wall (18LB) (FIGS. 4 and 5) of cross-bar 18 when it is desired to clamp it in PERPENDICULAR or PARALLEL orientation.

Thus this application shows four telescopic variants for returning a support extent 16 and a cross-bar 18 in either PERPENDICULAR or PARALLEL position, namely: FIGS. 5, 6; FIGS. 5A, 6A; FIGS. 9, 10 and FIGS. 17, 17A, 18. The embodiments of FIGS. 9, 10 and FIGS. 17, 17A, 18 are preferred because they lend themselves to rapid adjustment when the members are changed from one position to the other.

As a group the four variants are thought to fall within the description of providing: a first member having a manual control knob at one end rotatably mounted on one of said members 16 or 18 to extend longitudinally toward the other, said rotatable mounting defining an axis corresponding to said longitudinal extension direction, a fixed second member mounted on the other of said members 16 or 18 adapted to extend along said axis toward said one of said members 16 or 18 an intermediate member, rotatable about said axis relative to each of said first and second members, and mounted to slide axially relative thereto, means responsive to movement of said first member toward said second member and rotation in one sense to lock said first and said intermediate members, on the one hand and said intermediate and second members on the other in greater overlapped positions and to maintain said extent and cross bar in PERPENDICULAR orientation and responsive, when said members are in PERPENDICULAR orientation, to rotation of said first member in the other sense to allow movement of said first and intermediate members, on the one hand, and said intermediate and second members on the other hand to a lesser overlapped position where said extent and cross bar may be moved to PARALLEL position.

It is now proposed to describe the stake 600 which is shown in FIGS. 19 to 33. The features of the invention are embodied in the stake or in combination between the stake and other elements, as described.

The stake 600 may be of any section for most features described but the right angled L shape (FIG. 22) is preferred for easiest driving. It is easier to achieve undeflected entrance into the earth by square-cut tip 604 under impact blows on impact end 602. End 602 is preferably hardened to tolerate such blows by a sledge hammer or impacting tool.

Square-cut tip 604 will have inside and outside bevelling 604A and 604B for good entry.

FIGS. 21, 22 and 23 there is shown a jack. The jack allows a person of modest strength to withdraw stake. The jack comprises a standard 606 having a base 608 designed to rest on the earth and support the standard 606, and any stresses thereon. The upper end of the standard is provided with upstanding ears 610 designed to support the pivot pin 612 arranged to extend horizontally when the standard 606 is vertical. Pivotally mounted by means of the pin 612 is a lever 614. An alternate pivot location (not shown) may be provided to provide an alternate mechanical advantage. It will be seen that the lever has a long end, terminating in a manual grasping extent 616, and a short end terminating in tensile lifting means, to be described.

The tensile lifting means includes a chain 620 permanently fastened to the lever, adjacent to, but spaced from, the short end, by bolt 618.

Outwardly of bolt 618 the lever short end, terminates in two upward bights 622 and 624 at differing distances from the pivot point. The lever, short end, is dimensioned so that it may be inserted through any selected link in chain 620 to allow that link to rest in the selected one of bights 622 or 624. (Obviously more bights, at different distances from the pivot point, may be provided if desired). The chain may also pull upwardly directly from 618.

The lower chain end is selected to cooperate with engagement means mounted on the stake 600.

The stake is longitudinally extending with a square or tapered penetration end 604 and an impact end 602 which may be impacted by a sledge or conventional hammer, to drive the penetration edge into the earth. Such stake is preferably of steel, is L-shaped in section and has upper and intermediate spacers, 626 and 628 rigidly affixed (preferably by welding) thereto. The spacers are shaped to guide and slide a complementary shaped tubular upright 14 (FIG. 1) thereover. As will be noted, in plan view (FIG. 26) the sections are preferably apertured, for welding to the upright so that the stake is off centre relative to the spacer sections for a reason to be discussed hereafter.

Returning to the jack, means are provided, on the stake, between the spacers for attachment of the lower end of chain 620. Preferably a downwardly directed tine 630 is provided welded on the stake, adapted to receive any selected link of chain 620. If such a tine is provided it is attached and dimensioned so that it is received within the tubular member 14 bore when the latter is slid into overlapping position.

Instead of tine 630 a series of vertically spaced apertures (not shown) in the stake may be provided of which the appropriate one will be selected to receive a hook 631. This alternative is, however, not preferred, since such apertures tend to somewhat weaken the stake which must be driven under impacts. Alternatively a loop 633 may be welded to the stake to cooperate with hook 631 (FIG. 21).

The jack in operation, to lift the stake from the earth, requires the removal of the upright 14 from the stake 600. With the base 608 firmly positioned on the earth, the chain 620 is positioned so as to be taut with the lever oriented so that the short end slopes downwardly. For such taut positioning the lower end of the chain is connected applying the selected lower link to the tine 630 and the selected upper link to the selected bight 622 or 624. The lever is then manually pressed downwardly at long end extent 616. This step may be repeated with reselected chain links until the stake is loose from the earth. At any stage the bight or chain link may be reselected to improve the mechanical advantage.

The jack is preferably designed, as shown so that the lever may be pivoted into groove 632 defined in standard 606 so that it may be related to orientation parallel (FIG. 23) to the standard when not in use. For convenient storage the jack is designed so that in such parallel orientation (FIG. 23), the jack length is of approximately the length of the collapsed sign support (and of the stake). Dimples 635 in standard 606 will releasably retain the lever 614 in collapsed position.

In a preferred form of the invention, levelling means are provided to indicate when the stake is in vertical orientation. In one preferred form a spirit level 634 is located on the upper side of the upper of the guide plates 626 to indicate to the user, about to drive (and while driving) the stake, that the stake is vertical. A bracket, intermediate the guide plates may also be provided to support the level (not shown). An alternate means is shown in FIG. 19 wherein a pendular link 638 is formed and suspended on plate 626 with a simple suspension 640 (not shown in detail) that allows deflection in any azimuthal direction and a circular indication aperture 642 in a plate below. The plate may be guide plate 628 or an added plate. The aperture is arranged so that, when the stake is vertical, the free end of the link will occupy the center of the aperture. The link 638 may, after insertion, be provided with an enlargement not shown, below plate 626 to prevent chance removal.

It is understood that either alternative level means, or another alternative will be useful to allow adjustment before and just after the stake enters the earth, and will allow limited adjustment immediately after such entry, but thereafter the stake may not be returned to the vertical after the earth has achieved a firm grip upon the penetrating portion of the stake. However a significant reduction of the angle of the stake to the vertical in the final attitude is achieved by the use of a level means in the initial stages of driving the stake. Such reduction in the final deviation of the stake orientation from the vertical greatly enhances the neatness and attractiveness and professional appearance of the sign and of its support.

For removal of the stake, when the earth is frozen, there is provided a heater. The heater generally is arranged to heat the extent of the stake below the guide member 628 by extending from a terminal 644 down along the extent, back up the extent and to a second terminal 640. The terminals are arranged between the guide plates 626 and 628 as shown, to be insulated from the (preferably) steel stake and to terminate in projections suitable for grasping by the clamps 648 of an auto jumper cable. The projections are arranged to be inward of the tubular support 14 wall when the latter is in position. Leads 650 and 652 insulated from the stake connect the terminals to a conducting heater ribbon 615 on the extent below the lower guide plate. One end 654 of the ribbon connects to the lead from the terminal on the outer side of one of the leaves 606L of the L section. The ribbon extends, for the requisite extent, downwardly along one leaf, about a hairpin turn 656 upwardly along the same leaf, about a hairpin turn 658 over to the other leaf 606R, down the extent on the inside of the other leaf, about a hairpin turn 660 and up to lead 652 to the second terminal 646.

The conducting ribbon I prefer, (known as Nichrome Copper) is not insulated so I construct the heatable stake as follows: (See FIG. 19A and FIG. 24). The L shaped stake is, along the heated extent provided on each leaf with a strip of mica 662 attached thereto by glue (preferably Dow Corning 736 HT Silicon glue) and extending both longer and wider than the double width ribbon pattern on the leaf. The ribbon 615, in the pattern shown is then glued to each mica street and each outside end ribbon end is connected to one end of an ordinary, insulated lead 650 or 652 which connects the ribbon end to the corresponding terminal. On each leaf, a second sheet of mica 664 is glued over the ribbon patterns, the connection and outside of the patterns to the mica sheet 662. The heating connections and ribbon are completely insulated. In order to avoid damage to the element construction, as it is driven into the ground, a thin sheet of steel. 670 generally following the L-shaped contour is welded to the stake on each leaf edge at welds 672, at the bottom (not shown), thus protecting the element arrangement, and its mica insulation when it is driven into the ground. The power demand of the stake is not great since the temperature of the earth about the stake need only be raised a slight amount above freezing to create a melted environment for the stake and its easy withdrawal.

In operation, when it is desired to remove the stake just described, with the earth frozen, a car is driven to the proximity of the sign, and (preferably) with the car's engine running, jumper cables 676 are connected between respective battery terminals and respective stake terminals. When the earth is melted, in contact with the stake, the jumpers may be removed and the stake pulled out of the earth with or without the jack.

When a sign support 14, usually with sign 72 attached (FIG. 1) is resting on a stake 600, the sign and sign support present an attractive temptation to a casual vandal, if he need only slide the support off the stake and walk away with support and sign. Accordingly inhibiting means are provided to prevent such casual removal. It will be understood that with most support stake arrangements, there is a predetermined overlap between the support and the stake. In one preferred form of the inhibiting means a pair of apertures (one only shown) in opposed walls of the tubular member and an aperture (not shown) in the stake 600 are arranged to be aligned in the overlap position. (See FIG. 32). A shank 680 having on one end a head 682 and on the narrow end a transverse bore 684 is dimensioned to pass through the aligned apertures, narrow end first, to be locked by a simple padlock 686 applied through the shank, narrow end, aperture. For the use of this version of the inhibiting means stops (not shown) may be supplied to limit the overlap at a position where the apertures align, or the support may be held at this position while the shank is inserted.

Alternative removal inhibiting means comprise a deflectable tine 688 (FIGS. 25–29) located on the tubular member 18, is arranged to be deflected by the upper guide plate 626 on movement of member 18 downwardly into overlapping position, but to spring out to catch the guide plate when an attempt is made to remove it. The guide edges are provided with small indents 690 on opposed faces shaped to allow downward passage of a tine.

Various means are suggested to allow the tine to be pressed toward its adjacent wall, against its normal attitude, to allow the support tube to be moved upward past the guide.

In one alternative the tine is provided with a keyhole shaped aperture 693 (note dotted outline FIG. 26). Thus, when desired the blade 694 of the key 696 may be inserted through the keyhole then turned so that the key may be used to retract the tine and allow upward removal of the support 18.

In another alternative the tine aperture 693 is circular (solid outline FIG. 26). The implement 700 has a shank with a head 702 on one end associated with an outwardly spring biassed depressable plunger 704, and a pair of retractable projections 706 at the shank's other end.

With the plunger 704 depressed the projections 706 are retracted and the free end of the shank extended into the aperture. The plunger 704 is released, the projections extend to catch the tine which may then be retracted to allow removal of the support 14 Thereafter the plunger is again depressed, to allow removal of the implement through the apertures. The deflectable tine, may also be metal 710 rivetted to the wall of support located to contact the plate 626, and be operated by the means of FIGS. 26 or 27.

Alternatively (and preferably additionally) an aperture 712 may be provided in the wall opposite that which supports the tine 688 or 710 (FIG. 31). Any thin object: a nail a stick 714 etc. may be passed through this opposed aperture 712 to depress the tine and allow the removal of the tubular member. This is particularly advantageous where the key or implement above described has been misplaced.

None of the removal—inhibiting means will prevent removal of the sign support by a determined thief. However, they will deter the casual vandal.

It is preferable if the collapsed sign support and the stake are made of length to be conveniently carried in a car trunk. It is a preferred feature of this invention if the collapsed sign support and the stake are of approximately the same length (as indicated in FIG. 33) less than a predetermined length.

For the latter arrangement, an end opening box 716 of inside dimensions greater than said predetermined length and of section large enough to receive the collapsed support and stake side-by-side.

The box is provided with a lengthwise partition 718 to divide the box into separate compartments one 720 for the collapsed support and the other 722 for the stake. The separate compartments are preferred because the collapsed support will be composed of attractively finished material and the stake will be of rougher material and usually very wet and dirty.

A central carrying handle 726 and a closure 728 are provided for convenient carrying of the box.

The box will be preferably be waxed or water-proofed or provided with a plastic surface for use in all weather and on all surface conditions.

I claim:

1. In combination, sign support member and jack therefor, longitudinally extending stake having a penetration end and a driving end, said penetrating end being adapted to penetrate the earth surface responsive to impact on said driving and, means on said stake for supporting the upright of a sign thereon, said jack comprising:

a standard, a pad on one end thereof, said pad shaped to rest on said surface with said standard extending upward therefrom, a lever pivotally mounted toward the upper end of said standard to pivot about a substantially horizontal axis, said lever having a long, force input, end and a short, force output, end, cooperating means on said stake and said output end causing transfer of upward force supplied by said output end to said stake.

2. A combination as claimed in claim 1 having means for altering the mechanical advantage of said lever.

3. A combination as claimed in claim 1 wherein said cooperating means includes:

a chain having serially connected links, upper means for connecting one of said links to a force transmission point adjacent said short end of said lever whereby upward movement of said short end may provide upward tension on said chain, lower means for connecting another one said links to the stake whereby upward tension on said chain is applied to said stake.

4. A combination as claimed in claim 3 wherein said upper means allows the selection of any one of a first plurality of serially connected links as said one link.

5. A combination as claimed in claim 3 wherein said lower means allows the selection of any one of a second plurality of said serially connected links as said another link.

6. A sign support comprising:

a stake defining a longitudinal axis having a penetration end and a driving end, said penetrating end being adapted to penetrate the earth surface responsive to impacts on said driving end, means on said stake for supporting a sign thereon, level means mounted on said stake indicating when said stake is approximately vertical, said sign support being combined with a downwardly open tubular sign upright, said stake being provided with guides shaped to slidably guide and position said upright when said upright is slid downwardly thereover, wherein said guides and said level means are arranged so that said level means is received within said tubular upright when said upright is guided and positioned by said guides.

7. A combination as claimed in claim 6 wherein said level means is a spirit level.

8. A combination as claimed in claim 6 wherein said level means comprises a pendular member, and there are provided:

means supporting said pendular member at a first location on said stake, said supporting means allowing said pendulum member to hang vertically or at small angles to the vertical, indicator means mounted at a second location on said stake, arranged to indicate deviation of said pendular member from the vertical.

9. Support post comprising:

a longitudinal extent adapted to act as part of the upright for a sign, a cross-bar defining a longitudinal direction, means connecting said cross-bar with said extent, allowing pivotting therebetween, said connecting means allowing rotation of said cross-bar between an orientation perpendicular to said extent, and an orientation parallel thereto, and wherein said extent and cross-bar are shaped to interlock and to key against relative rotation when in said perpendicular orientation, wherein said extent and cross-bar together have a lesser thickness along a width axis perpendicular to both in the perpendicular orientation than in the parallel orientation, a first member having a manual control knob at one end rotatably mounted on one of said members to extend longitudinally toward the other, said rotatable mounting defining an axis corresponding to said longitudinal extension direction, a fixed second member mounted on the other of said members adapted to extend along said axis toward said one of said member, an intermediate member rotatable about said axis relative to each of said first and second members, and mounted to slide axially relative thereto, means responsive to movement of said first member toward said second member and rotation in one sense to lock said first and said intermediate members, on the one hand and said intermediate and second members on the other in greater overlapped positions and to maintain said extent and cross bar in perpendicular orientation, and responsive, when said members are in perpendicular orientation, to rotation of said first member in the other sense to allow movement of said first and intermediate members, on the one hand, and said intermediate and second members on the other hand to a lesser overlapped position where said extent and cross bar may be moved to parallel position.

10. Support post as claimed in claim 9, wherein said first member is a shank having a control means exterior to said one of said members, said intermediate member is a sleeve arranged to slidably receive said shank member, and said second member is shaped to receive said sleeve, studs on said sleeve engage an axial slot in said second member and are adapted to move into a right angled extension of said axial slot in said greater overlapped position, a diametrically extending rod across said sleeve, a slotted end on said first member on the end remote from said knob, shaped to receive said diametrically extending rod on axial movement of said members in an overlapping direction and slot shaped to allow rotational movement in said greater overlap position.

11. A sign support comprising:

a stake defining a longitudinal axis having a penetration end and a driving end, said penetrating end being adapted to penetrate the earth surface responsive to impacts on said driving end, means on said stake for supporting a sign thereon, level means mounted on said stake indicating when said stake is approximately vertical, wherein said level means comprises a pendular member, means supporting said pendular member at a first location on said stake, said supporting means allowing said pendular member to hang vertically or at small angles to the vertical, indicator means mounted at a second location on said stake, arranged to indicate deviation of said pendular member from the vertical.

12. Sign support member comprising:

longitudinally extending metal stake having a penetration end and a driving end, said penetrating end being adapted to penetrate the earth surface to a predetermined depth responsive to impacts on said driving end, means on said stake for supporting a sign thereon, a heating element mounted on and extending along an extent of said stake and insulated therefrom adapted when energized to heat said stake, a pair of terminals for said element arranged to be electrically accessible when said stake has penetrated to said predetermined depth.

13. In combination a sign support member as claimed in claim 12 with a downwardly open tubular sign upright, said stake being provided with guides shaped to slidably guide and position said upright when said upright is slid downwardly thereover, wherein said guides and said heating element are arranged so that said element is received within said upright when said upright is guided and positioned by said guides.

14. Sign support member as claimed in claim 12 wherein said terminals are conducting projections from said stake.

15. In combination, a sign support member as claimed in claim 14 and a downwardly open tubular sign upright, said stake being provided with guides shaped to slidably guide and position said upright when said upright is slid downwardly thereover, wherein said guides and said heating element are arranged so that said element and said projections are received within said upright is guided and positioned by said guides.

16. In combination: a sign support member comprising:

an upright and a cross bar, having an erected position and a collapsed position and being adapted in collapsed position to form a parallel bundle of longitudinally extending members of less than predetermined length, a longitudinally extending stake having a penetration end and a driving end, and adapted when said penetration end is projecting into the earth with said stake approximately vertical to support said upright in an approximately vertical position, the length of said stake being less than said predetermined length, a longitudinally extending container defining an inside space of said predetermined length, having an inner section longitudinally divided into at least two sections, being a first section to hold said bundle and second section to hold said stake, and an end opening for said container.

17. In combination, a sign support including a downwardly open tubular member, and a stake having a penetration end and a driving end, said driving end having guides to guide and support said tubular member when said tubular member is slid over said driving end to an overlapping position, and inhibit means operative after said tubular member is slid over said driving end to inhibit the removal of said tubular member from said stake, said inhibit means being subject to being rendered inoperable.

18. In combination as claimed in claim 17 wherein said means for inhibiting comprises:

passages in the opposed walls of said tubular member, aligned in overlapping position with a passage through said stake, a shank insertable through said stake, a shank insertable through said aligned passages and passage and means for inhibiting the withdrawal of said shank.

19. In combination as claimed in claim 17 wherein said means for inhibiting comprises:

catch means resiliently deflectable to allow sliding of said tubular member on to said stake, said catch means acting in overlapping position to prevent removal of said tubular member from said stake, means for manually deflecting said catch means when said members are in overlapping position, to allow release of said tubular member from said stake.

20. A sign support comprising:

a stake defining a longitudinal axis having a penetrations end and a driving end, said penetrating end being adapted to penetrate the earth surface responsive to impacts on said driving end, means on said stake for supporting a sign thereon, level means mounted on said stake indicating when said stake is approximately vertical, wherein said stake is of a right angled L shape in section perpendicular to the longitudinal axis and wherein said penetration end has a substantially square cut top.

21. A sign support as claimed in claim 20 wherein said square-cut tip has inside and outside bevelling.

* * * * *